US005890108A

United States Patent [19]

Yeldener

[11] Patent Number: 5,890,108

[45] **Date of Patent: *Mar. 30, 1999**

[54] LOW BIT-RATE SPEECH CODING SYSTEM AND METHOD USING VOICING PROBABILITY DETERMINATION

[75] Inventor: Suat Yeldener, Plainsboro, N.J.

[73] Assignee: Voxware, Inc., Princeton, N.J.

[ * ] Notice: The term of this patent shall not extend beyond the expiration date of Pat. No. 5,774,832.

[21] Appl. No.: 726,336

[22] Filed: Oct. 3, 1996

Related U.S. Application Data

[63] Continuation of Ser. No. 528,513, Sep. 13, 1995, Pat. No. 5,774,832.

[60] Provisional application No. 60/004,709 Oct. 3, 1995.

[51] Int. Cl.[6] ..... G10L 9/14; G10L 7/02

[52] U.S. Cl. ..... 704/208; 704/206; 704/219; 704/223; 704/262

[58] Field of Search ..... 704/206, 208, 704/219, 223, 262

[56] References Cited

U.S. PATENT DOCUMENTS

| | | | |
|---|---|---|---|
| 4,374,302 | 2/1983 | Vogten et al. | 704/265 |
| 4,392,018 | 7/1983 | Fette | 704/265 |

(List continued on next page.)

FOREIGN PATENT DOCUMENTS

| | | |
|---|---|---|
| 0 676 744 A1 | 10/1995 | European Pat. Off. . |
| WO 94/12972 | 6/1994 | WIPO . |

OTHER PUBLICATIONS

Daniel Wayne Griffin and Jae S. Lim, "Multiband Excitation Vocoder," IEEE Trans. on Acoustics, Speech, and Signal Processing, vol. 36, No. 8, pp. 1223–1235, Aug. 1988.

Masayuki Nishiguchi, Jun Matsumoto, Ryoji Wakatsuki, and Shinobu Ono, "Vector Quantized MBE With Simplified V/UV Division at 3.0 Kbps", Proc. IEEE ICASSP '93, vol. II, pp. 151–154, Apr. 1993.

Yeldener, Suat et al., "A High Quality 2.4 Kb/s Multi–Band LPC Vocoder and its Real–Time Implementation". Center for Satellite Enginering Research, University of Surrey. pp. 1–4. Sep. 1992.

Yeldener, Suat et al., "Natural Sounding Speech Coder Operating at 2.4 Kb/s and Below ", 1992 IEEE International Conference as Selected Topics in Wireless Communication, 25–26 Jun. 1992, Vancouver, BC, Canada, pp. 176–179.

(List continued on next page.)

*Primary Examiner*—David R. Hudspeth
*Assistant Examiner*—Tālivaldis Ivars Šmits
*Attorney, Agent, or Firm*—Pennie & Edmonds LLP

[57] ABSTRACT

A modular system and method is provided for low bit rate encoding and decoding of speech signals using voicing probability determination. The continuous input speech is divided into time segments of a predetermined length. For each segment the encoder of the system computes a model signal and subtracts the model signal from the original signal in the segment to obtain a residual excitation signal. Using the excitation signal the system computes the signal pitch and a parameter which is related to the relative content of voiced and unvoiced portions in the spectrum of the excitation signal, which is expressed as a ratio Pv, defined as a voicing probability. The voiced and the unvoiced portions of the excitation spectrum, as determined by the parameter Pv, are encoded using one or more parameters related to the energy of the excitation signal in a predetermined set of frequency bands. In the decoder, speech is synthesized from the transmitted parameters representing the model speech, the signal pitch, voicing probability and excitation levels in a reverse order. Boundary conditions between voiced and unvoiced segments are established to ensure amplitude and phase continuity for improved output speech quality. Perceptually smooth transition between frames is ensured by using an overlap and add method of synthesis. LPC interpolation and post-filtering is used to obtain output speech with improved perceptual quality.

32 Claims, 10 Drawing Sheets

U.S. PATENT DOCUMENTS

| | | | |
|---|---|---|---|
| 4,433,434 | 2/1984 | Mozer | 704/211 |
| 4,435,831 | 3/1984 | Mozer | 704/267 |
| 4,435,832 | 3/1984 | Asada et al. | 704/262 |
| 4,468,804 | 8/1984 | Kates et al. | 704/265 |
| 4,771,465 | 9/1988 | Bronson et al. | 704/207 |
| 4,797,926 | 1/1989 | Bronson et al. | 704/214 |
| 4,802,221 | 1/1989 | Jibbe | 704/208 |
| 4,856,068 | 8/1989 | Quatieri, Jr. et al. | 704/227 |
| 4,864,620 | 9/1989 | Bialick | 704/207 |
| 4,885,790 | 12/1989 | McAulay et al. | 704/265 |
| 4,937,873 | 6/1990 | McAulay et al. | 704/265 |
| 4,945,565 | 7/1990 | Ozawa et al. | 704/223 |
| 4,991,213 | 2/1991 | Wilson | 704/207 |
| 5,023,910 | 6/1991 | Thomson | 704/206 |
| 5,054,072 | 10/1991 | McAulay et al. | 704/207 |
| 5,081,681 | 1/1992 | Hardwick et al. | 704/268 |
| 5,189,701 | 2/1993 | Jain | 704/207 |
| 5,195,166 | 3/1993 | Hardwick et al. | 704/200 |
| 5,216,747 | 6/1993 | Hardwick et al. | 704/208 |
| 5,226,084 | 7/1993 | Hardwick et al. | 704/219 |
| 5,226,108 | 7/1993 | Hardwick et al. | 704/200 |
| 5,247,579 | 9/1993 | Hardwick et al. | 704/230 |
| 5,267,317 | 11/1993 | Kleijn | 704/217 |
| 5,303,346 | 4/1994 | Fesseler et al. | 704/230 |
| 5,327,518 | 7/1994 | George et al. | 704/211 |
| 5,327,521 | 7/1994 | Savic et al. | 704/272 |
| 5,339,164 | 8/1994 | Lim | 358/261.1 |
| 5,353,373 | 10/1994 | Drogo de lacovo et al. | 704/223 |
| 5,369,724 | 11/1994 | Lim | 704/206 |
| 5,491,772 | 2/1996 | Hardwick et al. | 704/226 |
| 5,517,511 | 5/1996 | Hardwick et al. | 371/37.4 |
| 5,630,012 | 5/1997 | Nishiguchi et al. | 704/208 |
| 5,717,821 | 2/1998 | Tsutsui et al. | 704/206 |
| 5,765,126 | 6/1998 | Tsutsui et al. | 704/206 |

OTHER PUBLICATIONS

Yeldener, Suat et al., "Low Bit Rate Speech Coding at 1.2 and 2.4 Kb/s", IEE Colloquium on Speech Coding—Techniques and Applications" (Digest No. 090) pp. 611–614, Apr. 14, 1992. London, U.K.

Yeldener, Suat et al., "High Quality Multi–Band LPC Coding of Speech at 2.4 Kb/s", Electronics Letters, v.27, N14, Jul. 4, 1991, pp. 1287–1289.

Medan, Yoav, et al., "Super Resolution Pitch Determination of Speech Signals". IEEE Transactions on Signal Processing, vol. 39, No. 1, Jan. 1991.

McAulay, Robert J. et al., "Computationally Efficient Sine–Wave Synthesis and its Application to Sinusoidal Transform Coding" M.I.T. Lincoln Laboratory, Lexington, MA. 1988 IEEE, S9.1 pp. 370–373.

Hardwick, John C., "A 4.8 KBPS Multi–BAND Excitation Speech Coder". M.I.T. Research Laboratory of Electronics; 1988 IEEE, S9.2., pp. 374–377.

Thomson, David L., "Parametric Models of the Magnitude/Phase Spectrum for Harmonic Speech Coding". AT&T Bell Laboratories; 1988 IEEE, S9.3., pp. 378–381.

Marques, Jorge S. et al., "A Background for Sinusoid Based Representation of Voiced Speech". ICASSP 86, Tokyo, pp. 1233–1236.

Trancoso, Isabel M., et al., "A Study on the Relationships Between Stochastic and Harmonic Coding". INESC, ICASSP 86, Tokyo. pp. 1709–1712.

McAulay, Robert J. et al., "Phase Modelling and its Application to Sinusoidal Transform Coding". M.I.T. Lincoln Laboratory, Lexington, MA. 1986 IEEE, pp. 1713–1715.

McAulay, Robert J. et al., "Mid–Rate Coding Based on a Sinusoidal Representation of Speech". Lincoln Laboratory, Massachusetts Institute of Technology, Lexington, MA. 1985 IEEE, pp. 945–948.

Almeida, Luis B., "Variable–Frequency Synthesis: An Improved Harmonic Coding Scheme". 1984, IEEE, pp. 27.5.1–27.5.4.

McAulay, Robert J. et al., "Magnitude–Only Reconstruction Using A Sinusoidal Speech Model", M.I.T. Lincoln Laboratory, Lexington, MA. 1984 IEEE, pp. 27.6.1–27.6.4.

Nats Project; Eigensystem Subroutine Package (EISPACK) F286–2 HQR. "A Fortran IV Subroutine to Determine the Eigenvalues of a Real Upper Hessenberg Matrix", Jul. 1975, pp. 330–337.

LOW BIT-RATE SPEECH CODING SYSTEM AND METHOD USING VOICING PROBABILITY DETERMINATION

This application is a continuation of application Ser. No. 08/528,513, filed Sep. 13, 1995, now U.S. Pat. No. 5,774, 832, and claims the benefit of U.S. Provisional application Ser. No. 60/004,709, filed Oct. 3, 1995.

BACKGROUND OF THE INVENTION

The present invention relates to speech processing and more specifically to a method and system for low bit rate digital encoding and decoding of speech using separate processing of voiced and unvoiced components of speech signal segments on the basis of a voicing probability determination.

Digital encoding of voiceband speech has been subject to intensive research for at least three decades now, as a result of which various techniques have been developed targeting different speech processing applications at bit rates ranging from about 64 kb/s to about 2.4 kb/s. Two of the main factors which influence the choice of a particular speech processing algorithm are the desired speech quality and the bit rate. Generally, the lower the bit rate of the speech coder, i.e. higher signal compression, the more the speech quality suffers to some extent. In each specific application, it is thus a matter of compromise between the desired speech quality, which in many instances is strictly specified, and the information capacity of the transmission channel and/or the speech processing system which determine the bit rate. The present invention is specifically directed to a low bit rate system and method for speech and voiceband coding to be used in speech processing and modern multimedia systems which require large volumes of data to be processed and stored, often in real time, and acceptable quality speech to be delivered over narrowband communication channels.

For practical low bit rate digital speech signal transformation, communication and storage purposes it is necessary to reduce the amounts of data to be transmitted and stored by eliminating redundant information without significant degradation of the output speech quality. There are some well known prior art speech signal compression and coding techniques which exploit signal redundancies to reduce the required bit rate. Generally, these techniques can be classified as speech processing using analysis-and-synthesis (AAS) and analysis-by-synthesis (ABS) methods. Although AAS methods, such as residual excited linear predictive coding (RELP), adaptive predictive coding (APC) and subband coding (SBC) have been successful at rates in the range of about 9.6–16 kb/s, below that range they can no longer produce good quality speech. The reasons for that are generally related to the fact that: (a) there is no feedback mechanism to control the distortions in the reconstructed speech; and (b) errors in one speech frame generally propagate in subsequent frames without correction. In ABS schemes, on the other hand, both these factors are taken into account which enables them to operate much more successfully in the low bit rate range.

Specifically, in ABS coding systems it is assumed that the signal can be observed and represented in some form. Then, a theoretical signal production model is assumed which has a number of adjustable parameters to model different ranges of the input signal. By varying parameters of the model in a systematic way it is thus possible to find a set of parameters that can produce a synthetic speech signal which matches the real signal with minimum error. In practical applications synthetic speech is most often generated as the output of a linear predictive coding (LPC) filter. Next, a residual, "excitation" signal is obtained by subtracting the synthetic model speech signal from the actual input signal. Generally, the dynamic range of the residual signal is much more limited, so that fewer bits are required for its transmission and storage. Finally, perceptually based minimization procedures can be employed to reduce the speech distortions at the synthesis end even further.

Various techniques have been used in the past to design the speech model filter, to form an appropriate excitation signal and minimize the error between the original signal and the synthesized output in some meaningful way. There appears to be a consensus, however, that no single technique is likely to succeed in all applications. The reason for this is that the performance of digital compression and coding systems for voice signals is highly dependent on the speaker and the selection of speech frames. The success of a technique selected in a particular application thus frequently depends on the accuracy of the underlying signal model and the flexibility in adjusting the model parameters. As known in the art, various speech signal models have been proposed in the past.

Most frequently, speech is modeled on a short-time basis as the response of a linear system excited by a periodic impulse train for voiced sounds or random noise for the unvoiced sounds. For mathematical convenience, it is assumed that the speech signal is stationary within a given short time segment, so that the continuous speech is represented as an ordered sequence of distinct voiced and unvoiced speech segments.

Voiced speech segments, which correspond to vowels in a speech signal, typically contribute most to the intelligibility of the speech which is why it is important to accurately represent these segments. However, for a low-pitched voice, a set of more than 80 harmonic frequencies ("harmonics") may be measured within a voiced speech segment within a 4 kHz bandwidth. Clearly, encoding information about all harmonics of such segment is only possible if a large number of bits is used. Therefore, in applications where it is important to keep the bit rate low, more sophisticated speech models need to be employed.

One typical approach is to separate the speech signal into its voiced and unvoiced components. The two components are then synthesized separately and finally combined to produce the complete speech signal. For example, U.S. Pat. No. 4,771,465 describes a speech analyzer and synthesizer system using a sinusoidal encoding and decoding technique for voiced speech segments and noise excitation or multipulse excitation for unvoiced speech segments. In the process of encoding the voiced segments a fundamental subset of harmonic frequencies is determined by a speech analyzer and is used to derive the parameters of the remaining harmonic frequencies. The harmonic amplitudes are determined from linear predictive coding (LPC) coefficients. The method of synthesizing the harmonic spectral amplitudes from a set of LPC coefficients, however, requires extensive computations and yields relatively poor quality speech.

Different techniques focus on more accurate modeling of the excitation signal. The excitation signal in a speech coding system is very important because it reflects residual information which is not covered by the theoretical model of the signal. This includes the pitch, long term and random patterns, and other factors which are critical for the intelligibility of the reconstructed speech. One of the most important parameters in this respect is the is the determination of the accurate pitch. Studies have shown that the human ear is more sensitive to changes in the pitch compared to changes in other speech signal parameters by an order of magnitude, which is why a number of techniques to accurately estimate the pitch have been proposed in the past. For example, U.S. Pat. Nos. 5,226,108 and 5,216,747 to Hardwick et al. describe an improved pitch estimation method providing sub-integer resolution. The quality of the output speech according to the proposed method is improved by increasing the accuracy of the decision as to whether given speech segment is voiced or unvoiced. This decision is made by comparing the energy of the current speech segment to the energy of the preceding segments. The proposed methods, however, generally do not allow accurate estimation of the amplitude information for all harmonics.

In an approach related to the harmonic signal coding techniques discussed above, it has been proposed to increase the accuracy of the signal reconstruction by using a series of binary voiced/unvoiced decisions corresponding to each speech frame in what is known in the art as multiband excitation (MBE) coders. The MBE speech coders provide more flexibility in the selection of speech voicing compared with traditional vocoders, and can be used to generate good quality speech. In fact, an improved version of the MBE (IMBE) vocoder operating at 4.15 kb/s, with forward error correction (FEC) making it up to 6.4 kb/s, has been chosen for use in INMARSAT-M. In these speech coders, however, typically the number of harmonic magnitudes in the 4 kHz bandwidth varies with the fundamental frequency, requiring variable bit allocation for each harmonic magnitude from one frame to another, which can result in variable speech quality for different speakers. Another limitation of the IMBE coder is that the bit allocation for the model parameters depends on the fundamental frequency, which reduces the robustness of the system to channel errors. In addition, errors in the voiced/unvoiced decisions, especially when made in the low frequency bands, result in perceptually objectionable degradation in the quality of the output speech.

Therefore, it is perceived that there exists a need for more flexible methods for encoding and decoding of speech, which can be used in low bit rate applications. Accordingly, there is a present need to develop a modular system in which optimized processing of different speech segments, or speech spectrum bands, is performed in specialized processing blocks to achieve best results for different types of speech and other acoustic signal processing applications. Furthermore, there is a need to more accurately classify each speech segment in terms of its voiced/unvoiced content in order to apply optimum signal compression for each type of signal. In addition, there is a need to obtain accurate estimates of the amplitudes of the spectral harmonics in voiced speech segments in a computationally efficient way and to develop a method and system to synthesize such voiced speech segments without the requirement to store or transmit separate phase information.

SUMMARY OF THE INVENTION

Accordingly, it is an object of the present invention to provide a modular system and method for encoding and decoding of speech signals at low to very low bit rates on the basis of a voicing probability determination.

It is another object of the present invention to provide a novel encoder in which, following an analysis-by synthesis spectrum modeling, the voiced and the unvoiced portion of the excitation signal, as determined by the voicing probability of the frame, are processed separately for optimal coding.

It is yet another object of the present invention to provide a speech synthesizer which, on the basis of the voicing probability of the signal in each frame, synthesizes the voiced and the unvoiced portions of the excitation signal separately and combines them into a composite reconstructed excitation signal for the frame; the reconstructed excitation signal is then combined with the signal in adjacent speech segments with minimized amplitude and phase distortions and passed through a model filter to obtain output speech of good perceptual quality.

These and other objectives are achieved in accordance with the present invention by means of a novel modular encoder/decoder speech processing system in which the input speech signal is represented as a sequence of frames (time segments) of predetermined length. The spectrum S(w) of each such frame is modeled as the output of a linear time-varying filter which receives on input excitation signal with certain characteristics. Specifically, the time-varying filter is assumed to be an all-pole filter, preferably an LPC filter with a pre-specified number of coefficients which can be obtained using the standard Levinson-Durbin algorithm. Next is constructed a synthetic speech signal spectrum using LPC inverse filtering based on the computed LPC model filter coefficients. The synthetic spectrum is removed from the original signal spectrum to result in a generally flat excitation spectrum, which is then analyzed to obtain the remaining parameters required for the low bit rate encoding of the speech signal. For optimal storage and transmission the LPC coefficients are replaced with a set of corresponding line spectral frequencies (LSF) coefficients which have been determined for practical purposes to be less sensitive to quantization, and also lend themselves to intra-frame interpolation. The latter feature can be used to further reduce the bit rate of the system.

In accordance with a preferred embodiment of the present invention the excitation spectrum is completely specified by several parameters, including the pitch (the fundamental frequency of the segment), a voicing probability parameter which is defined as the ratio between the voiced and the unvoiced portions of the spectrum, and one or more parameters related to the excitation energy in different parts of the signal spectrum. In a specific embodiment of the present invention directed to a very low bit rate system, a single parameter indicating the total energy of the signal in a given frame is used.

In particular, the system of the present invention determines the pitch and the voicing probability Pv for the segment using a specialized pitch detection algorithm. Specifically, after determining a value for the pitch, the excitation spectrum of the signal is divided into a number of frequency bins corresponding to frequencies harmonically elated to the pitch. If the normalized energy in a bin, i.e., the error between the original spectrum of the speech signal in the frame and the synthetic spectrum generated from the LPC inverse filter, is less than the value of a frequency-dependent adaptive threshold, the bin is determined to be voiced; otherwise the bin is considered to be unvoiced. The voicing probability Pv is computed as the ratio of the number of voiced frequency bins over the total number of bins in the spectrum of the signal. In accordance with a preferred embodiment of the present invention it is assumed that the low frequency portion of the signal spectrum contains a predominantly voiced signal, while the high frequency portion of the spectrum contains predominantly the unvoiced portion of the speech signal, and the boundary between the two is determined by the voicing probability Pv.

Once the voicing probability Pv is determined, the speech segment is separated into a voiced portion, which is assumed to cover a Pv portion in the low-end of the spectrum, and an unvoiced portion occupying the remainder of the spectrum. In a specific embodiment of the present invention directed to a very low bit rate system, a single parameter indicating the total energy of the signal in a given frame is transmitted. In an alternative embodiment, the spectrum of the signal is divided into two or more bands, and the average energy for each band is computed from the harmonic amplitudes of the signal that fall within each band. Advantageously, due to the different perceptual importance of different portions of the spectrum, frequency bands in the low end of the spectrum (its voiced portion) can be linearly spaced, while frequency bands in the high end of the spectrum can be spaced logarithmically for higher coding efficiency. The computed band energies are then quantized for transmission. A parameter encoder finally generates for each frame of the speech signal a data packet, the elements of which contain information necessary to restore the original speech segment. In a preferred embodiment of the present invention, a data packet comprises: control information, the LSF coefficients for the model LPC filter, the voicing probability Pv, the pitch, and the excitation power in each spectrum band. Instead of transmitting the actual parameter values for each frame, in an alternative embodiment of the present invention only the differences from the preceding frames can be transmitted. The ordered sequence of data packets at the output of the parameter encoder is ready for storage or transmission of the original speech signal.

At the synthesis end, a decoder receives the ordered sequence of data packets representing speech signal segments. In a preferred embodiment, the unvoiced portion of the excitation signal in each time segment is reconstructed by selecting, dependent on the voicing probability Pv, of a codebook entry which comprises a high pass filtered noise signal. The codebook entry signal is scaled by a factor corresponding to the energy of the unvoiced portion of the spectrum. To synthesize the voiced excitation signal, the spectral magnitude envelope of the excitation signal is first re-constructed by linearly interpolating between values obtained from the transmitted spectrum band energy (or energies). This envelope is sampled at the harmonic frequencies of the pitch to obtain the amplitudes of sinusoids to be used for synthesis. The voiced portion of the excitation signal is finally synthesized from the computed harmonic amplitudes using a harmonic synthesizer which provides amplitude and phase continuity to the signal of the preceding speech segment. The reconstructed voiced and unvoiced portions of the excitation signal are combined to provide a composite output excitation signal which is finally passed through an LPC model filter to obtain a delayed version of the input signal.

Several modifications to the basic algorithm described above can be used to enhance the performance of the system. For example, the frame by frame update of the LPC filter coefficients can be adjusted to take into account the temporal characteristics of the input speech signal.

Specifically, in order to model frame transitions more accurately, the update rate of the analysis window can be adjusted adaptively. In a specific embodiment, the adjustment is done using frame interpolation of the transmitted LSFs. Advantageously, the LSFs can be used to check the stability of the corresponding LPC filter; in case the resulting filter is unstable, the LSF coefficients are corrected to provide a stable filter. This interpolation procedure has been found to automatically track the formants and valleys of the speech signal from one frame to another, as a result of which the output speech is rendered considerably smoother and with higher perceptual quality.

In addition, in accordance with a preferred embodiment of the present invention a post-filter is used to further shape the excitation noise signal and improve the perceptual quality of the synthesized speech. The post-filter can also be used for harmonic amplitude enhancement in the synthesis of the voiced portion of the excitation signal.

Due to the separation of the input signal in different portions, it is possible to use the method of the present invention to develop different processing systems with operating characteristics corresponding to user-specific applications. Furthermore, the system of the present invention can easily be modified to generate a number of voice effects with applications in various communications and multimedia products.

BRIEF DESCRIPTION OF THE DRAWINGS

The invention will be next be described in detail by reference to the following drawings in which.

DETAILED DESCRIPTION OF THE INVENTION

During the course of the description like numbers will be used to identify like elements shown in the figures. Bold face letters represent vectors, while vector elements and scalar coefficients are shown in standard print.

Figure 1:
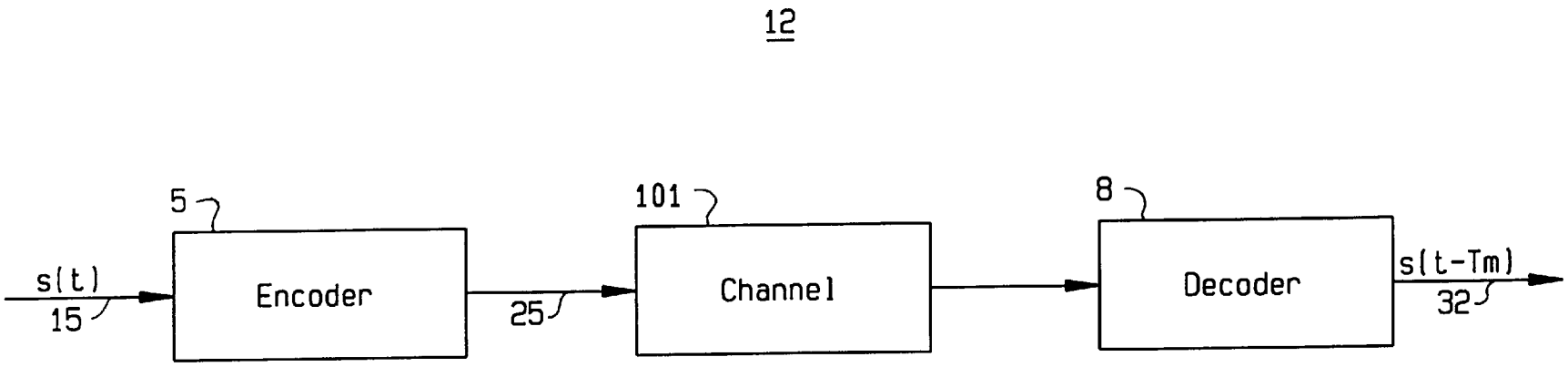
FIG. 1 is a block diagram of the speech processing system of the present invention.

FIG. 1 is a block diagram of the speech processing system 12 for encoding and decoding speech in accordance with the present invention. Analog input speech signal s(t) (15) from an arbitrary voice source is received at encoder 5 for subsequent storage or transmission over a communications channel 101. Encoder 5 digitizes the analog input speech signal 15, divides the digitized speech sequence into speech segments and encodes each segment into a data packet 25 of length I information bits. The ordered sequence of encoded speech data packets 25 which represent the continuous speech signal s(t) are transmitted over communications channel 101 to decoder 8. Decoder 8 receives data packets 25 in their original order to synthesize a digital speech signal which is then passed to a digital-to-analog converter to produce a time delayed analog speech signal 32, denoted s(t−Tm), as explained in more detail next. The system of the present invention is described next with reference to a specific preferred embodiment which is directed to processing of speech at very low bit rates.

A. The Encoder

Figure 2:
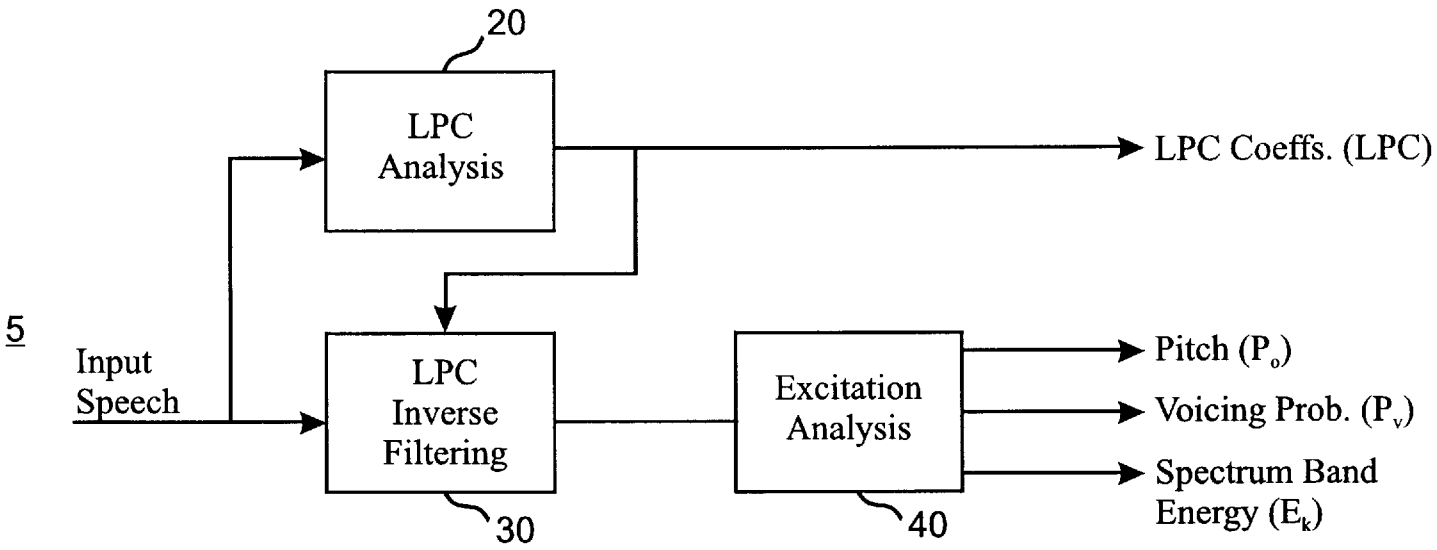
FIG. 2 is a schematic block diagram of the encoder used in a preferred embodiment of the system of the present invention.

FIG. 2 illustrates in greater detail the main elements of encoder 5 and their interconnections in a preferred embodiment of a speech coder. Not shown in FIG. 2, signal pre-processing is first applied, as known in the art, to facilitate encoding of the input speech. In particular, analog input speech signal 15 is low pass filtered to eliminate frequencies outside the human voice range. The low pass filtered analog signal is then passed to an analog-to-digital converter where it is sampled and quantized to generate a digital signal s(n) suitable for subsequent processing.

As known in the art, digital signal s(n) is next divided into frames of predetermined dimensions. In a specific embodiment of the present invention operating at 2.4 kb/s rate 211 samples are used to form one speech frame. In order to minimize signal distortions at the transitions between adjacent frames a preset number of samples, in a specific embodiment, about 60 samples from each frame overlap with the adjacent frame. In a preferred embodiment, the separation of the input signal into frames is accomplished using a circular buffer, which is also used to set the lag between different frames and other parameters of the pre-processing stage of the system.

In accordance with a preferred embodiment of the present invention, the spectrum S(ω) of the input speech signal in a frame of a predetermined length is represented using a speech production model in which speech is viewed as the result of passing a substantially flat excitation spectrum E(ω) through a linear time-varying filter H(ω,t), which models the resonant characteristics of the speech spectral envelope as:

$$S(\omega)=E(\omega)H(\omega,t) \tag{1}$$

In accordance with a preferred embodiment of the present invention the time-varying filter in Eq. (1) is assumed to be an all-pole filter, preferably a LPC filter with a predetermined number of coefficients. It has been found that for practical purposes an LPC filter with 10 coefficients is adequate to model the spectral shape of human speech signals. On the other hand, in accordance with the present invention the excitation spectrum E(ω) in Eq. (1) is specified by a set of parameters including the signal pitch, the excitation RMS values in one or more frequency bands, and a voicing probability parameter Pv, as discussed in more detail next.

More specifically, with reference to FIG. 2, the speech production model parameters (LPC filter coefficients) are estimated in LPC analysis block 20 in order to minimize the mean squared error (MSE) between the original spectrum $S_\omega(\omega)$ and the synthetic spectrum $\hat{S}(\omega)$. After computing the coefficients of the LPC filter, the input signal is inverse filtered in block 30 to subtract the synthetic spectrum from the original signal spectrum, thus forming the excitation spectrum E(ω). The parameters used in accordance with the present invention to represent the excitation spectrum of the signal are then estimated in excitation analysis block 40. As shown in FIG. 2, these parameters include the pitch $P_0$ of the signal, the voicing probability for the segment and one or more spectrum band energy coefficients $E_k$. Thus, in accordance with a preferred embodiment of the present invention encoder 5 of the system outputs for storage and transmission only a set of LPC coefficients (or the related LSFs), representing the model spectrum for the signal, and the parameters of the excitation signal estimated in analysis block 40.

A.1 Speech production model parameters

In accordance with a preferred embodiment of the present invention the time-varying filter modeling the spectrum of the signal is an LPC filter. The advantage of using an LPC model for spectral envelope representation is to obtain a few parameters that can be effectively quantized at low bit rates. To determine these parameters, rather than minimizing the residual energy in the time domain, the goal is to fit the original speech spectrum $S_\omega(\omega)$ to an all-pole model R(ω) such that the error between the two is minimized. The all-pole model can be written as $$R(\omega)=GH(\omega)=\frac{G}{A(\omega)}=\frac{G}{1+\sum_{k=1}^{p}a_k e^{-jk\omega}} \tag{2}$$

where G is a gain factor, p is the number of poles in the spectrum and A(ω) is known as the inverse LPC filter. The MSE error $E_r$, between $S_\omega(\omega)$ and R(ω) is given by $$E_r=\sum_{\omega=-N/2}^{\omega=N/2}|S_\omega(\omega)|^2|A(\omega)|^2=G^2\sum_{\omega=-N/2}^{\omega=N/2}\left(\frac{|S_\omega(\omega)|}{|R(\omega)|}\right)^2 \tag{3}$$

The parameters $\{a_k\}$ are then determined by minimizing the error $E_r$ with respect to each $a_k$ parameter. As known in the art, the solution to this minimization problem is given by the following set of equations:

$$\sum_{k=1}^{p}a_k R_{|i-k|}=-R_i;\ 1\leqq i\leqq p \tag{4}$$

where $$R_k=\sum_{\omega=-N/2}^{N/2}|S_\omega(\omega)|^2\cos(k\omega) \tag{5}$$

where

Figure 6:
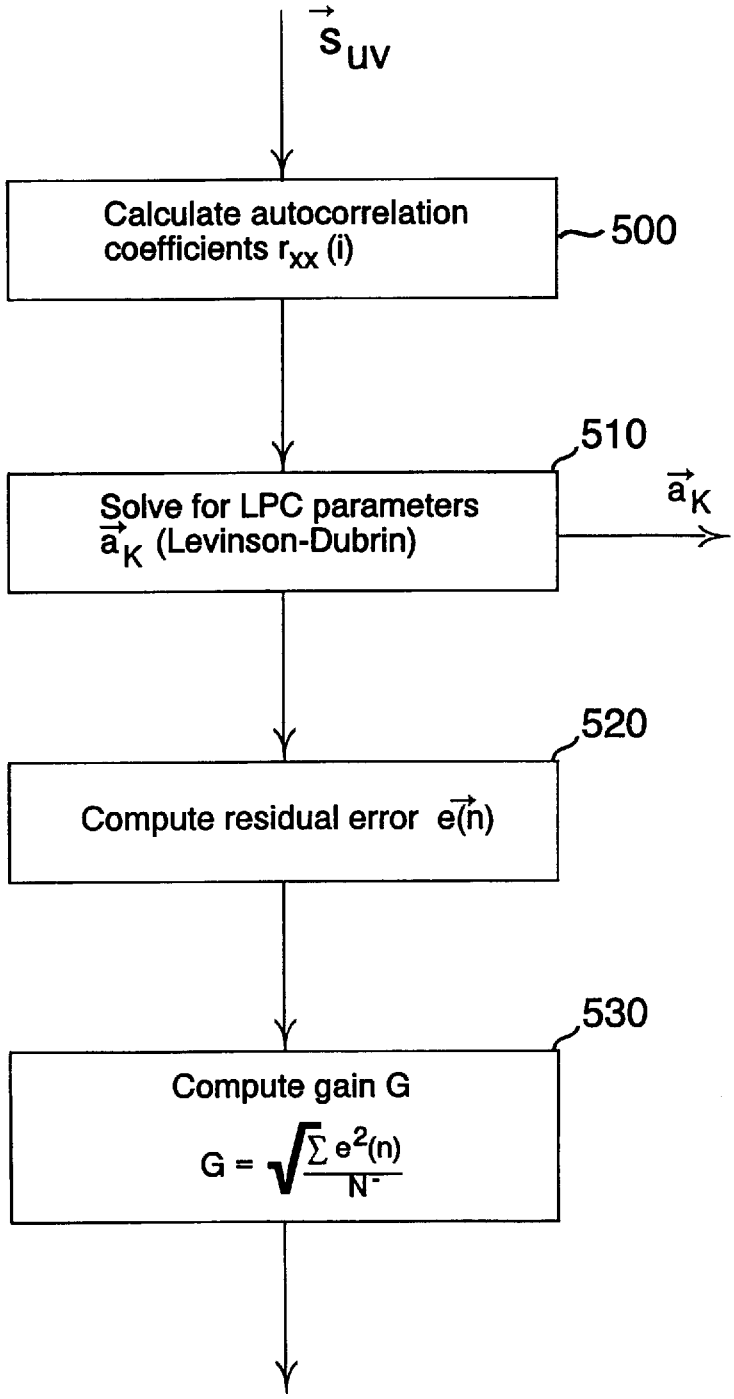
FIG. 6 shows in a flow-chart form the computation of the parameters of the LPC model filter.

Equation (4) represents a set of p linear equations in p unknowns which may be solved for $\{a_k\}$ using the Levinson-Durbin algorithm, as shown in FIG. 6. This algorithm is well known in the art and is described, for example, in S. J. Orphanidis, "Optimum Signal Processing," McGraw Hill, New York, 1988, pp. 202–207, which is hereby incorporated by reference. In a preferred embodiment of the present invention the number p of the preceding speech samples used in the prediction is set equal to about 6 to 10. Similarly, it is known that the gain parameter G can be calculated as:

$$G^2=R_0+\sum_{k=1}^{p}a_k R_k \tag{6}$$

A.2 Excitation Model Parameters

As the LPC spectrum is a close estimate of the spectral envelope of the speech spectrum, its removal is bound to result in a relatively flat excitation signal. Notably, the information content of the excitation signal is substantially uniform over the spectrum of the signal, so that estimates of the residual information contained in the spectrum are generally more accurate compared to estimates obtained directly from the original spectrum. As indicated above, the residual information which is most important for the purposes of optimally coding the excitation signal comprises the pitch, the voicing probability and the excitation spectrum energy parameters, each one being considered in more detail next.

Figure 4:
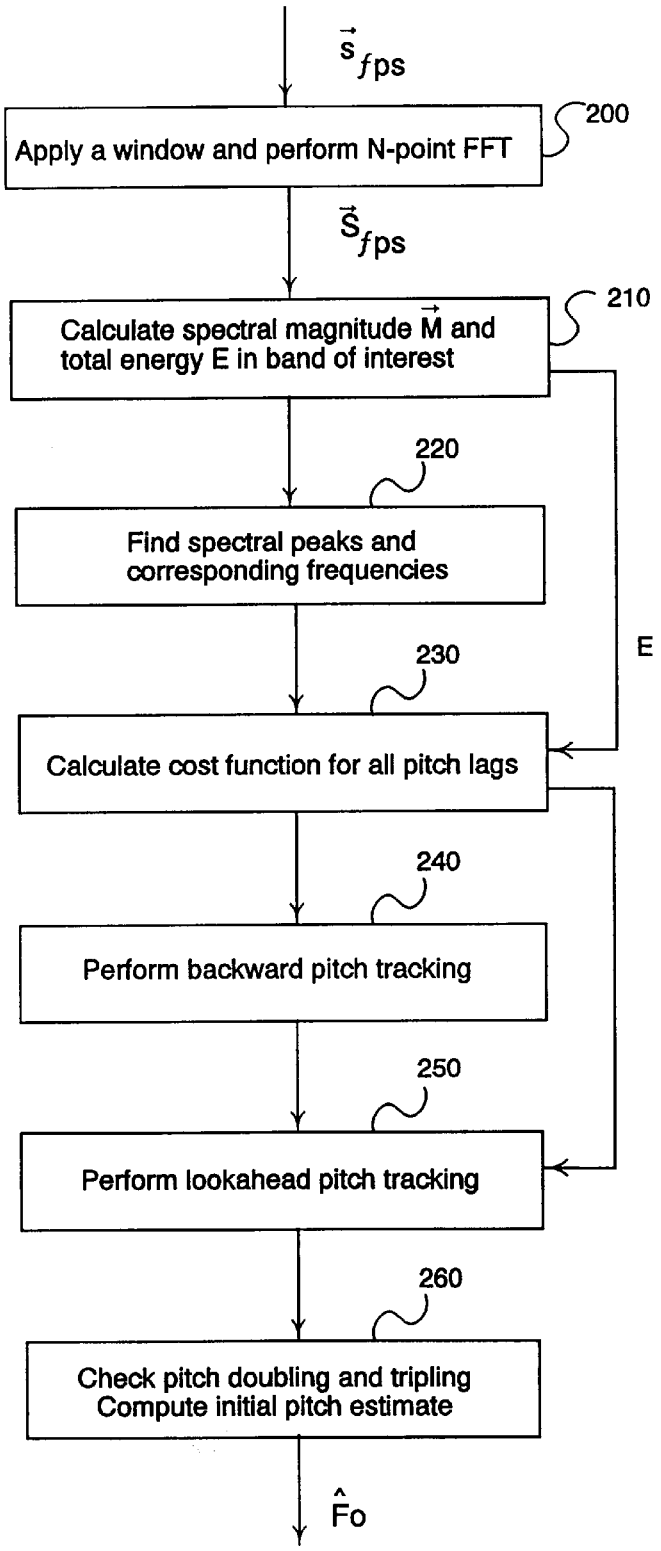
FIG. 4 is a flow-chart of the pitch detection algorithm in accordance with a preferred embodiment of the present invention.

Turning next to FIG. 4, it shows a flow-chart of the pitch detection algorithm in accordance with a preferred embodiment of the present invention. Pitch detection plays a critical role in most speech coding applications, especially for low bit rate systems, because the human ear is more sensitive to changes in the pitch compared to changes in other speech signal parameters by an order of magnitude. Typical problems include mistaking submultiples of the pitch for its correct value in which case the synthesized output speech will have multiple times the actual number of harmonics. The perceptual effect of making such a mistake is having a male voice sound like female. Another significant problem is ensuring smooth transitions between the pitch estimates in a sequence of speech frames. If such transitions are not smooth enough, the produced signal exhibits perceptually very objectionable signal discontinuities. Therefore, due to the importance of the pitch in any speech processing system, its estimation requires a robust, accurate and reliable computation method. In accordance with a preferred embodiment of the present invention the pitch detector used in block 20 of the encoder 5 operates in the frequency domain.

Accordingly, with reference to FIG. 2, the first function of block 40 in the encoder 5 is to compute the signal spectrum S(k) for a speech segment, also known as the short time spectrum of a continuous signal, and supply it to the pitch detector. The computation of the short time signal spectrum is a process well known in the art and therefore will be discussed only briefly in the context of the operation of encoder 5.

Specifically, it is known in the art that to avoid discontinuities of the signal at the ends of speech segments and problems associated with spectral leakage in the frequency domain, a signal vector $y_M$ containing samples of a speech segment should be multiplied by a pre-specified window w to obtain a windowed speech vector $y_{WM}$. The specific window used in the encoder 5 of the present invention is a Hamming or a Kaiser window, the elements of which are scaled to meet the constraint:

$$1 = \frac{1}{M} \sum_{m=0}^{M-1} w^2(m) \tag{7}$$

The use of Kaiser and Hamming windows is described for example in Oppenheim et al., "Discrete Time Signal Processing," Prentice Hall, Englewood Hills, N.J., 1989. For a Kaiser window $W_K$ elements of vector $y_{WM}$ are given by the expression:

$$y_{WM}(n)=W_K(n)\cdot y(n);\ n=0,1,2,\ldots,M-1 \tag{8}$$

The input windowed vector $y_{WM}$ is next padded with zeros to generate a vector $y_N$ of length N defined as follows:

$$\begin{aligned} y_N(n) &= y_{WM}(n) \text{ for } n = 0, \ldots, M-1 \\ &= 0 \text{ for } n = M, \ldots, N-1 \end{aligned} \tag{9}$$

The zero padding operation is required in order to obtain an alias-free version of the discrete Fourier transform (DFT) of the windowed speech segment vector, and to obtain spectrum samples on a more finely divided grid of frequencies. It can be appreciated that dependent on the desired frequency separation, a different number of zeros may be appended to windowed speech vector $y_{WM}$.

Following the zero padding, a N point discrete Fourier transform of speech vector $y_N$ is performed to obtain the corresponding frequency domain vector $F_N$. Preferably, the computation of the FFT is executed using any fast Fourier transform (FFT) algorithm. As well known, the efficiency of the FFT computation increases if the length N of the transform is a power of 2, i.e. if $N=2^L$. Accordingly, in a specific embodiment of the present invention the length N of the speech vector is initially adjusted by adding zeros to meet this requirement.

A.2.1 Pitch Estimation

In accordance with a preferred embodiment of the present invention estimation of the pitch generally involves a two-step process. In the first step, the spectrum of the input signal $S_{fps}$ sampled at the "pitch rate" $f_{ps}$ is used to compute a rough estimate of the pitch $F_0$. In the second step of the process the pitch estimate is refined using a spectrum of the signal sampled at a higher regular sampling frequency $f_s$. Preferably, the pitch estimates in a sequence of frames are also refined using backward and forward tracking pitch smoothing algorithms which correct errors for each pitch estimate on the basis of comparing it with estimates in the adjacent frames. In addition, the voicing probability Pv of the adjacent segments, discussed in more detail next, is also used in a preferred embodiment of the invention to define the scope of the search in the pitch tracking algorithm.

More specifically, with reference to FIG. 4, at step 200 of the method an N-point FFT is performed on the signal sampled at the pitch sampling frequency $f_{ps}$. As discussed above, prior to the FFT computation the input signal of length N is windowed using preferably a Kaiser window of length N.

In the following step 210 are computed the spectral magnitudes M and the total energy E of the spectral components in a frequency band in which the pitch signal is normally expected. Typically, the upper limit of this expectation band is assumed to be between about 1.5 to 2 kHz. Next, in step 220 are determined the magnitudes and locations of the spectral peaks within the expectation band by using a simple routine which computes signal maxima. The estimated peak amplitudes and their locations are designated as $\{A_i, W_i\}^L_{i=J}$ respectively where L is the number of peaks in the expectation band.

The search for the optimal pitch candidate among the peaks determined in step 220 is performed in the following step 230. Conceptually, this search can be thought of as defining for each pitch candidate of a comb-filter comprising the pitch candidate and a set of harmonically related amplitudes. Next, the neighborhood around each harmonic of each comb filter is searched for an optimal peak candidate.

Specifically, within a pre-specified search distance d around the harmonics of each pitch candidate, the maxima of the actual speech signal spectrum are checked to determine the optimum spectral peak. A suitable formula used in accordance with the present invention to compute the optimum peak is given by the expression:

$$e_k A_i \cdot d(w_i, kw_o) \tag{10}$$

where $e_k$ is weighted peak amplitude for the k-th harmonic; $A_i$ is the i-th peak amplitude and $d(w_i, kw_o)$ is an appropriate distance measure between the frequency of the i-th peak and the k-th harmonic within the search distance. A number of functional expressions can be used for the distance measure $d(w_i, kw_o)$. Preferably, two distance measures, the performance of which is very similar, can be used:

$$1:\ d(w_i,kw_o) = \cos[2\pi(w_i - kw_o)] \tag{11A}$$

$$2:\ d(w_i,kw_o) = \frac{\sin[2\pi(w_i - kw_o)]}{2\pi(W_i - kw_o)} \tag{11B}$$

In accordance with the present invention the determination of an optimum peak depends both on the distance function $d(w_i, kw_o)$ and the peak amplitudes within the search distance. Therefore, it is conceivable that using such function an optimum can be found which does not correspond to the minimum spectral separation between a pitch candidate and the spectrum peaks.

Once all optimum peak amplitudes corresponding to each harmonic of the pitch candidates are obtained, a normalized cross-correlation function is computed between the frequency response of each comb-filter and the determined optimum peak amplitudes for a set of speech frames in accordance with the expression:

$$R_{Fr}(n) = \frac{\sum_{k=i}^{H} (h_k \cdot e_k)}{\sum_{i=1}^{L} A_i^2} - \frac{1}{2} \cdot \frac{\sum_{k=1}^{H} h_k^2}{\sum_{i=1}^{L} A_i^2} \tag{12}$$

where $-2 \leqq Fr \leqq 3$ and $h_k$ are the harmonic amplitudes of the teeth of comb-filter, H is the number of harmonic amplitudes, and n is a pitch lag which can vary. The second term in the equation above is a bias factor, an energy ratio between harmonic amplitudes and peak amplitudes, that reduces the probability of encountering a pitch doubling problem.

In a preferred embodiment of the present invention the pitch of frame $Fr_1$ is estimated using backward and forward pitch tracking to maximize the cross-correlation values from one frame to another which process is summarized as follows: blocks 240 and 250 in FIG. 4 represent respectively backward pitch tracking and lookahead pitch tracking which can in be used in accordance with a preferred embodiment of the present invention to improve the perceptual quality of the output speech signal. The principle of pitch tracking is based on the continuity characteristic of the pitch, i.e. the property of a speech signal that once a voiced signal is established, its pitch varies only within a limited range. (This property was used in establishing the search range for the pitch in the next signal frame, as described above). Generally, pitch tracking can be used both as an error checking function following the main pitch determination process, or as a part of this process which ensures that the estimation follows a correct, smooth route, as determined by the continuity of the pitch in a sequence of adjacent speech segments.

In a specific embodiment of the present invention, the pitch $P_1$ of frame $F_1$ is estimated using the following procedure. Considering first the backward tracking mechanism, in accordance with the pitch continuity assumption, the pitch period $P_1$ is searched in a limited range around the pitch value $P_0$ for the preceding frame $F_0$. This condition is expressed mathematically as follows:

$$(1-\alpha)\cdot P_0 \leqq P_1 \leqq (1+\alpha)\cdot P_0$$

where $\alpha$ determines the range for the pitch search and is typically set equal to 0.25. The cross-correlation function $R_1(P)$ for frame $F_1$, as defined in Eq. (12) above, is considered at each value of P which falls within the defined pitch range. Next, the values $R_1(P)$ for all pitch candidates in the range given above are compared and a backward pitch estimate $P_b$ is determined by maximizing the $R_1(P)$ function over all pitch candidates. The average cross-correlation values for the backward frames are then computed using the expression:

$$C_b(P_b) = \frac{\left[ R_1(P_b) + \sum_{i=0}^{-(M-1)} R_i(P_i) \right]}{M} \tag{13}$$

where $P_i$, $R_i(P_i)$ are the pitch estimates and corresponding cross-correlation functions for the previous (M−1) frames, respectively.

Turning next to the forward tracking mechanism, it is again assumed that the pitch varies smoothly between frames. Since the pitch has not yet been determined for the M−1 future frames, the forward pitch tracking algorithm selects the optimum pitch for these frames. This is done by first restricting the pitch search range, as shown above. Next, assuming that $P_1$ is fixed, the values of the pitch in the future frames $\{P_{i+1}\}^{M-1}$ are determined as to maximize the cross-correlation functions $\{R_{i+1}(P)\}^{M-1}$ in the range. Once the set of values $\{P_i\}^{M-1}$ has been determined, the forward average cross-correlation function, $C_f(P)$ is calculated, as in the case of backward tracking, using the expression:

$$C_f(P_f) = \frac{\left[ R_1(P_f) + \sum_{i=1}^{(M-1)} R_{i+1}(P_{i+1}) \right]}{M} \tag{14}$$

This process is repeated for each pitch candidate. The corresponding values of $C_f(P)$ are compared and the forward pitch, $P_f$ is chosen which results in the maximum value of $C_f(P)$ function. The maximum backward cross-correlation $C_b(P_b)$ is finally compared against the maximum forward average cross-correlation and the larger value is used to determines the optimum pitch $P_1$.

In an alternative embodiment of the present invention, the search for the optimum pitch candidate uses the voicing probability parameter Pv for the previous frame. (The voicing probability parameter is discussed in more detail in the following section). In particular, Pv is compared against a pre-specified threshold and if it is larger than the threshold, it is assumed that the previous frame was predominantly voiced. Because of the continuity characteristic of the pitch, it is assumed that its value in the present frame will remain close to the value of the pitch in the preceding frame. Accordingly, the pitch search range can be limited to a predefined neighborhood of its value in the previous frame, as described above. Alternatively, if the voicing probability Pv of the preceding frame is less than the defined threshold, it is assumed that the speech frame was predominantly unvoiced, so that the pitch period in the present frame can assume an arbitrary value. In this case, a full search for all potential pitch candidates is performed.

The mechanism for pitch tracking described above is related to a specific embodiment of the present invention. Alternate algorithms for pitch tracking are known in the prior art and will not be considered in detail. Useful discussion of this topic can be found, for example, in A. M. Kondoz, "Digital Speech: Coding for Low Bit Rate Communication Systems," John Wiley & Sons, 1994, the relevant portions of which are hereby incorporated by reference for all purposes.

With reference to FIG. 4, finally, in step 260 a check is made whether the estimated pitch is not in fact a submultiple of the actual pitch.

A.2.2 Pitch Sub-Multiple Check

The sub-multiple check algorithm in accordance with the present invention can be summarized as follows:

1. Integer and sub-multiples of the estimated pitch are first computed to generate the ordered list $$\left(\frac{P_1}{2}, \frac{P_1}{3}, \ldots, \frac{P_1}{n}\right)$$

2. The average harmonic energy for each sub-multiple candidate is computed using the expression:

$$E(w_k) = \frac{1}{L_k} \sum_{i=1}^{L_k} A^2(i \cdot w_k); k = 1, 2, \ldots, n \tag{15}$$

where $L_k$ is the number of harmonics, $A(i \cdot W_k)$ are harmonic magnitudes and $$w_k = \frac{2\pi}{P_{1/k}}$$

is the frequency of the $k^{th}$ sub-multiple of the pitch. The ratio between the energy of the smallest sub-multiple and the energy of the first sub-multiple, $P_i$, is then calculated and is compared with an adaptive threshold which varies for each sub-multiple. If this ratio is larger than the predetermined threshold, the sub-multiple candidate is selected as the actual pitch. Otherwise, the next largest sub-multiple is checked. This process is repeated until all sub-multiples have been tested.

3. If none of the sub-multiples of the pitch satisfy the condition in step 2, the ratio r given in the following expression is computed.

$$r = \frac{R_1\left(\frac{P_1}{k}\right)}{R_1(P_1)}; k = 2, 3, \ldots, n \tag{16}$$

The ratio r is then compared with another adaptive threshold which varies for each sub-multiple. If r is larger than the corresponding threshold, it is selected as the actual pitch, otherwise, this process is iterated until all sub-multiples are checked. If none of the sub-multiples of the initial pitch satisfy the condition, then $P_1$ is selected as the pitch estimate.

A.2.3 Pitch Smoothing

In accordance with a preferred embodiment of the present invention the pitch is estimated at least one frame in advance. Therefore, as indicated above, it is a possible to use pitch tracking algorithms to smooth the pitch $P_0$ of the current frame by looking at the sequence of previous pitch values ($P_{-2}$, $P_{-1}$) and the pitch value ($P_1$) for the first future frame. In this case, if $P_{-2}$, $P_{-1}$ and $P_1$ are smoothly varied from one to another, any jump in the estimate of the pitch $P_0$ of the current frame away from the path established in the other frames indicates the possibility of an error which may be corrected by comparing the estimate $P_0$ to the stored pitch values of the adjacent frames, and "smoothing" the function which connects all pitch values. Such a pitch smoothing procedure which is known in the art improves the synthesized speech significantly.

While the pitch detection was described above with reference to a specific preferred embodiment which operates in the frequency domain, it should be noted that other pitch detectors can be used in block 40 (FIG. 2) to estimate the fundamental frequency of the signal in each segment. Specifically, an autocorrelation or average magnitude difference function (AMDF) detectors that operate in the time domain, or a hybrid detector that operates both in the time and the frequency domain can be also be employed for that purpose.

A.2.4 Voicing Determination

Traditional speech processing algorithms classify each speech frame either as purely voiced or unvoiced based on some pre-specified fixed decision threshold. Recently, in multiband excitation (MBE) vocoders, the speech spectrum of the signal was modeled as a combination of both unvoiced and voiced portions of the speech signal by dividing the speech spectrum into a number of frequency bands and making a binary voicing decision for each band. In practice, however, this technique is inefficient because it requires a large number of bits to represent the voicing information for each band of the speech spectrum. Another disadvantage of this multiband decision approach is that since the voicing determination is not always accurate and voicing errors, especially when made in low frequency bands, can result in output signal buzziness and other artifacts which are perceptually objectionable to listeners.

In accordance with the present invention, a new method is proposed for representing voicing information efficiently. Specifically, in a preferred embodiment of the method it is assumed that the low frequency components of a speech signal are predominantly voiced and the high frequency components are predominantly unvoiced. The goal is then to find a border frequency that separates the signal spectrum into such predominantly low frequency components (voiced speech) and predominantly high frequency components (unvoiced speech). It should be clear that such border frequency changes from one frame to another. To take into account such changes, in accordance with a preferred embodiment of the present invention the concept of voicing probability Pv is introduced. The voicing probability Pv generally reflects the amount of voiced and unvoiced components in a speech signal. Thus, for a given signal frame Pv=0 indicates that there are no voiced components in the frame; Pv=1 indicates that there are no unvoiced speech components; the case when Pv has a value between 0 and 1 reflects the more common situation in which a speech segment is composed of a combination of both voiced and unvoiced signal portions, the relative amounts of which are expressed by the value of the voicing probability Pv. Notably, unlike standard subband coding schemes in which the signal is segmented in the frequency domain into bands having fixed boundaries, in accordance with the present invention the separation of the signal into voiced and unvoiced spectrum portions is flexible and adaptively adjusted for each signal segment.

Figure 5:
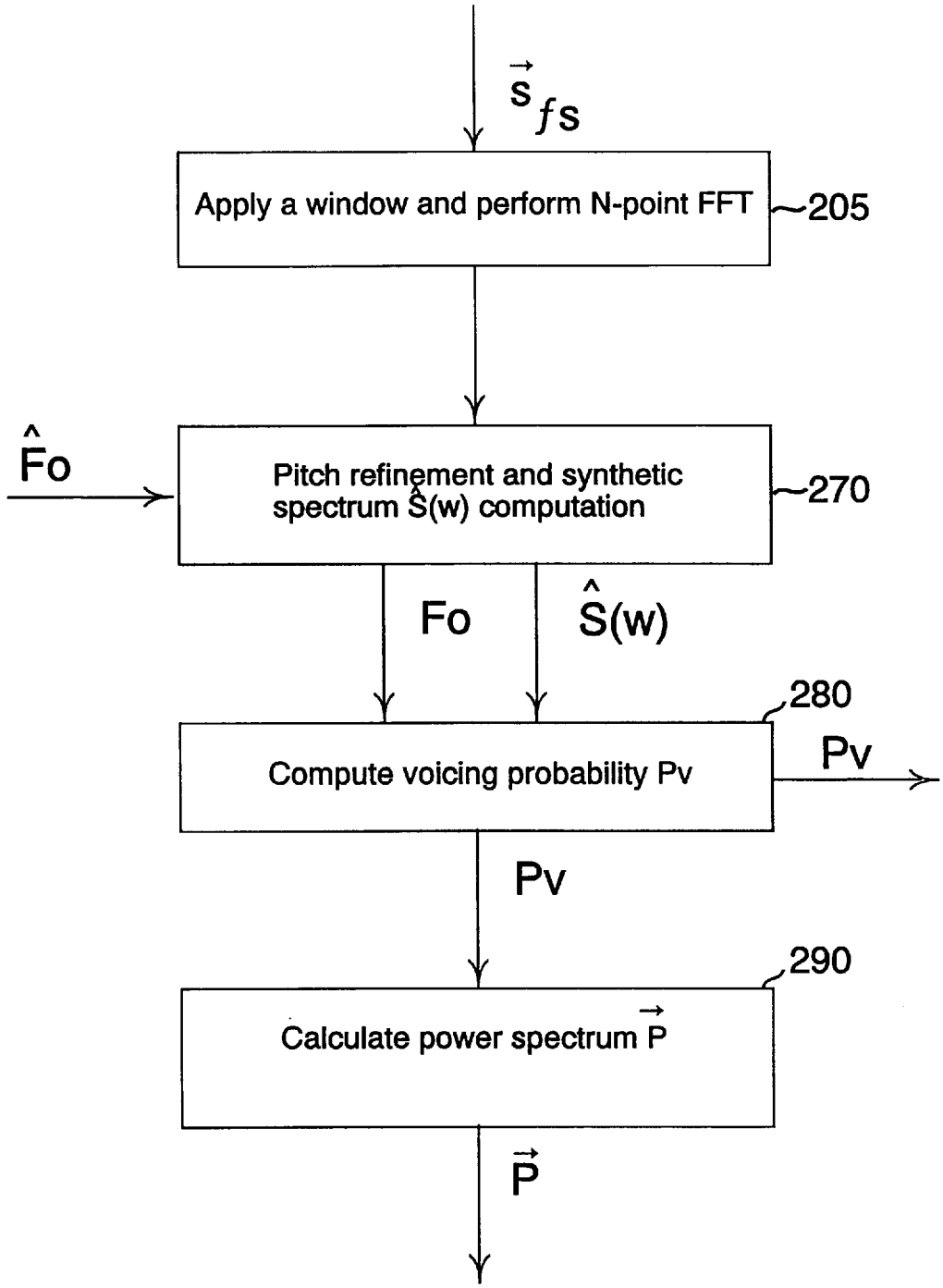
FIG. 5 is a flow-chart of the voicing probability computation algorithm of the present invention.

With reference to FIG. 5, the determination of the voicing probability, along with a refinement of the pitch estimate is accomplished as follows. In step 205 of the method, the spectrum of the speech segment at the standard sampling frequency $f_s$ is computed using an N-point FFT. (It should be noted that the pitch estimate can be computed either from the input signal, or from the excitation signal on the output of block 30 in FIG. 2).

In the next block 270 the following method steps take place. First, a set of pitch candidates are selected on a refined spectrum grid about the initial pitch estimate. In a preferred embodiment, about 10 different candidates are selected within the frequency range P−1 to P+1 of the initial pitch estimate P. The corresponding harmonic coefficients $A_i$ for each of the refined pitch candidates are determined next from the signal spectrum $S_{fs}(k)$ and are stored. Next, a synthetic speech spectrum is created about each pitch candidate based on the assumption that the speech is purely voiced. The synthetic speech spectrum S(w) can be computed as:

$$\hat{s}(w) = \sum_{k=1}^{H} |s(kw_0)| \cdot \mathrm{sinc}(w - kw_0) \tag{17}$$

where $|S(k\omega_0)|$ is the original speech spectrum magnitude sampled at the harmonics of the pitch $F_0$, H is the number of harmonics and:

$$\mathrm{sinc}(w - kw_0) = \frac{\sin[2\pi(w - kw_0)]}{2\pi(w - kw_0)} \tag{18}$$

is a sinc function which is centered around each harmonic of the fundamental frequency.

The original and synthetic excitation spectra corresponding to each harmonic of fundamental frequency are then compared on a point-by-point basis and an error measure for each value is computed and stored. Due to the fact that the synthetic spectrum is generated on the assumption that the speech is purely voiced, the normalized error will be relatively small in frequency bins corresponding to voiced harmonics, and relatively large in frequency bins corresponding to unvoiced portions of the signal. Thus, in accordance with the present invention the normalized error for the frequency bin around each harmonic can be used to decide whether the signal in a bin is predominantly voiced or unvoiced. To this end, the normalized error for each harmonic bin is compared to a frequency-dependent threshold. The value of the threshold is determined in a way such that a proper mix of voiced and unvoiced energy can be obtained. The frequency-dependent, adaptive threshold can be calculated using the following sequence of steps:

1. Compute the energy of a speech signal.
2. Compute the long term average speech signal energy using the expression:

$$Z_{avg}(n) = \begin{cases} \dfrac{[z_0(n) + z_{avg}(n-1)]}{2.0}; & z_0(N) > Z_{avg}(n-1) \\ \alpha \cdot Z_{avg}(n-1) + \beta Z_0(n); & \text{otherwise} \end{cases}$$

where $z_0(n)$ is the energy of the speech signal.

3. Compute the threshold parameter using the expression:

$$T_C = \frac{(\gamma \cdot Z_{avg}(n) + z_0(n))}{(\mu \cdot Z_{avg}(n) + z_0(n))} \tag{19}$$

4. Compute the adaptive, frequency dependent threshold function:

$$T_a(w) = T_c \cdot [a \cdot w + b] \tag{20}$$

where the parameters $\alpha$, $\beta$, $\gamma$, $\mu$, a and b are constants that can be determined by subjective tests using a group of listeners which can indicate a perceptually optimum ratio of voiced to unvoiced energy. In this case, if the normalized error is less than the value of the frequency dependent adaptive threshold function, $T_a(w)$, the corresponding frequency bin is then determined to-be voiced; otherwise it is treated as being unvoiced.

In summary, in accordance with a preferred embodiment of the present invention the spectrum of the signal for each segment is divided into a number of frequency bins. The number of bins corresponds to the integer number obtain by computing the ratio between half the sampling frequency $f_s$ and the refined pitch for the segment estimated in block 270 in FIG. 5. Next, a synthetic speech signal is generated on the basis of the assumption that the signal is completely voiced, and the spectrum of the synthetic signal is compared to the actual signal spectrum over all frequency bins. The error between the actual and the synthetic spectra is computed and stored for each bin and then compared to a frequency-dependent adaptive threshold. Frequency bins in which the error exceeds the threshold are determined to be unvoiced, while bins in which the error is less than the threshold are considered to be voiced.

Unlike prior art solutions in which each frequency bin is processed on the basis of the voiced/unvoiced decision, in accordance with a preferred embodiment of the present invention the entire signal spectrum is separated into two bands. It has been determined experimentally that usually the low frequency band of the signal spectrum represents voiced speech, while the high frequency band represents unvoiced signal. This observation is used in the system of the present invention to provide an approximate solution to the problem of separating the signal into voiced and unvoiced bands, in which the boundary between voiced and unvoiced spectrum bands is determined by the ratio between the number of voiced harmonics within the spectrum of the signal and the total number of frequency harmonics, i.e. using the expression:

$$P_v = \frac{H_v}{H} \tag{21}$$

where $H_v$ is the number of voiced harmonics that are estimated using the above procedure and H is the total number of frequency harmonics for the entire speech spectrum. Accordingly, the voicing cut-off frequency is then computed as:

$$w_c = P_v \cdot \pi \tag{22}$$

which defines the border frequency that separates the unvoiced and voiced portion of speech spectrum. The voicing probability Pv is supplied on output to block 280 in FIG. 5. Finally, in block 290 in FIG. 5 is computed the power spectrum $P_V$ of the harmonics.

A.2.5 Excitation Spectrum Band Energies

Dependent on the required bit rate for the overall system, in accordance with the present invention two separate methods can be used to encode the energy of the excitation spectrum. In a first preferred embodiment directed to very low bit rate systems, a single parameter corresponding to the energy of the excitation spectrum is stored or transmitted. Specifically, if the total energy of the excitation signal is equal to E, where $$E = \sum_{i=0}^{N} e^2(n)$$

and e(n) is the time domain error signal obtained at the output of the LPC inverse filter (block 30 in FIG. 2), it has been determined that L harmonics of the pitch are present, a single amplitude parameter A need only be transmitted:

$$A = \sqrt{\frac{E}{L(N+1)}} \tag{22}$$

In an alternative preferred embodiment, in order to provide more flexibility in coding the excitation spectral magnitude information, the whole spectrum is divided into a certain number of bands (between about 8 to 10) and the average energy for each band is computed from the harmonic magnitudes that fall in the corresponding band. Preferably, frequency bands in the voiced portion of the spectrum can be separated using linearly spaced frequencies while bands that fall within the unvoiced portion of the spectrum can be separated using logarithmically spaced frequencies. These band energies are then quantized and transmitted to the receiver side, where the spectral magnitude envelope is reconstructed by linearly interpolating between the band energies.

A.2.6 Quantization

In accordance with a preferred embodiment of the present invention, output parameters from the encoding block 5 are finally quantized for subsequent storage and/or transmission. Several algorithms can be used to that end, as known in the art. In a specific embodiment, the LPC coefficients representing the model of the signal spectrum are first transformed to line spectrum coefficients (LSF). Generally, LSFs encode speech spectral information in the frequency domain and have been found to be less sensitive to quantization than the LPC coefficients. In addition, LSFs lend themselves to frame-to-frame interpolation with smooth spectral changes because of their close relationship with the formant frequencies of the input signal. This feature of the LSFs is used in the present invention to increase the overall coding efficiency of the system because only the difference between LSF coefficient values in adjacent frames need to be transmitted in each segment. The LSF transformation is known in the art and will not be considered in detail here. For additional information on the subject one can consult, for example, Kondoz, "Digital Speech: Coding for Low Bit Rate Communication Systems," John Wiley & Sons, 1994, the relevant portions of which are hereby incorporated by reference.

The quantized output LSF parameters are finally supplied to an encoder to form part of a data packet representing the speech segment for storage and transmission. In a specific embodiment of the present invention directed to a 2.4 kb/s system, 31 bits are used for the transmission of the model spectrum parameters, 4 bits are used to encode the voicing probability, 8 bits are used to represent the value for the pitch, and about 5 bits can be used to encode the excitation spectrum energy parameter.

B. The Decoder

Figure 3:
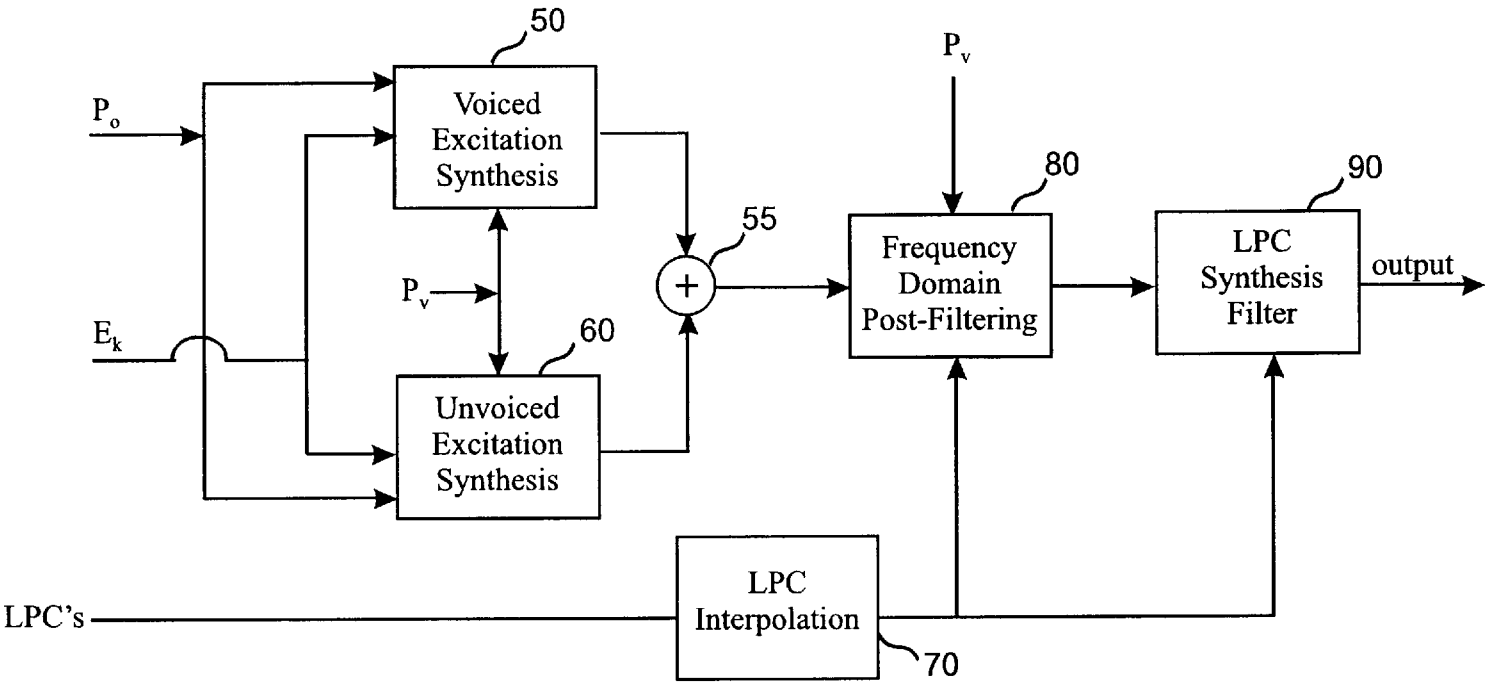
FIG. 3 illustrates in a schematic block-diagram form the decoder used in a preferred embodiment of the present invention.

FIG. 3 shows in a schematic block-diagram form the decoder used in accordance with a preferred embodiment of the present invention. As indicated in the figure, the voiced portion of the excitation signal is generated in block 50; the unvoiced portion of the excitation signal is generated separately in block 60, both blocks receiving on input the voicing probability Pv, the pitch $P_0$, and the excitation energy parameter(s) $E_k$. The output signals from blocks 50 and 60 are added in adder 55 to provide a composite excitation signal. On the other hand, the encoded model spectrum parameters are used to initiate the LPC interpolation filter 70. Finally, frequency domain post-filtering block 80 and LPC synthesis block 90 cooperate the re-construct the original input signal, as discussed in more detail next.

Figure 9:
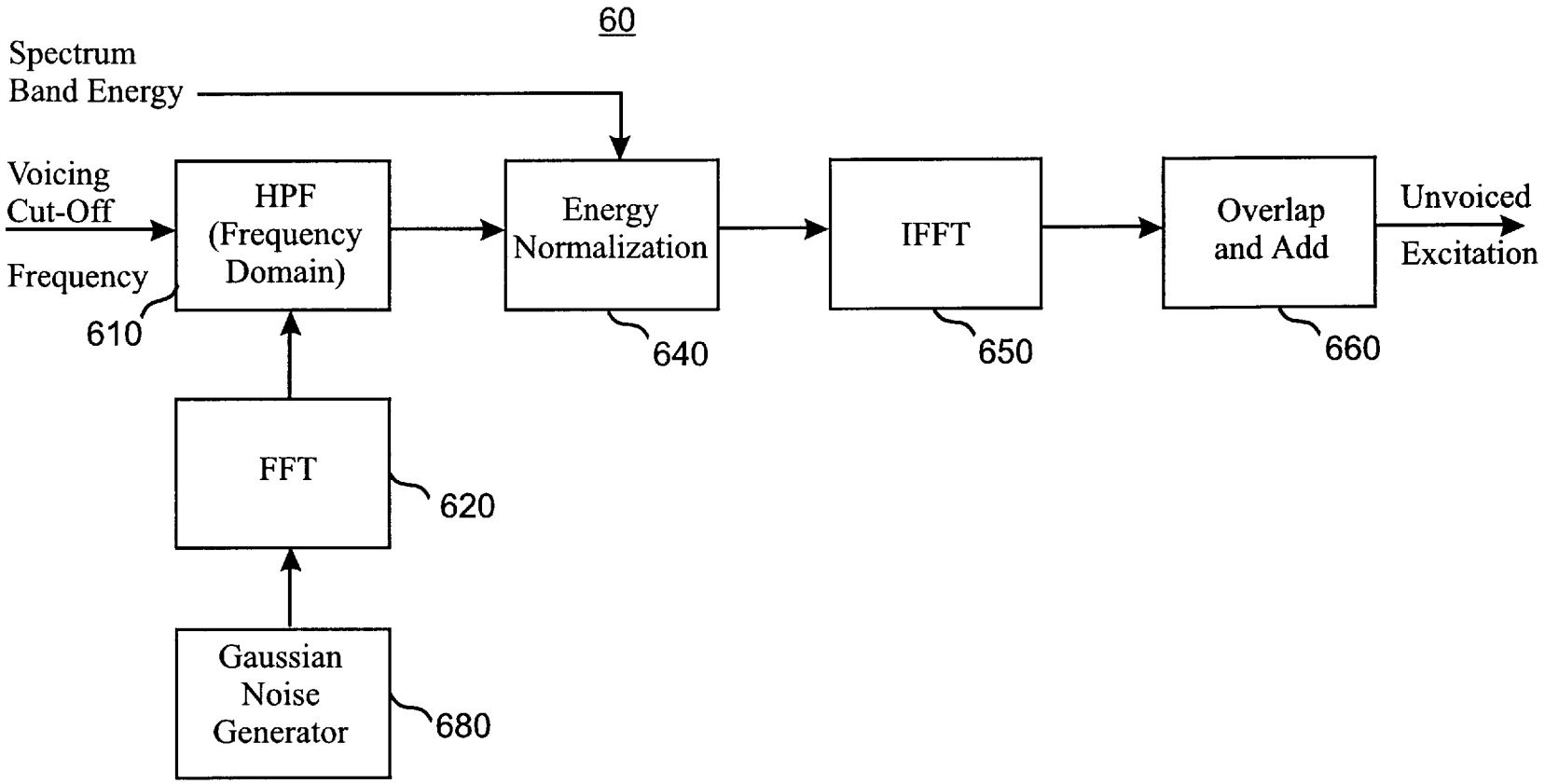
FIG. 9 illustrates a method of generating the unvoiced portion of the excitation signal in accordance with the present invention.

The operation of unvoiced excitation synthesis block 60 is illustrated in FIG. 9 and can briefly be described as taking the short time Fourier transform (STFT) of a white noise sequence and zeroing out the frequency regions marked in accordance with the voicing probability parameter Pv as being voiced. The synthetic unvoiced excitation can then be produced from an inverse STFT using a weighted overlap-add method. The samples of the unvoiced excitation signal are then normalized to have the desired energy level σ. With reference to FIG. 9, a white Gaussian noise sequence is generated in block 630 and is transformed in the frequency domain in FFT block 620. The output from block 620 is then used, in high pass filter 610, to synthesize the unvoiced part of excitation on the basis of the voicing probability of the signal. Since the voiced portion of speech spectrum (low frequencies) is processed by another algorithm, a high pass filter in frequency domain is used to simply zero out the voiced components of the spectrum.

Next, in block 640, the frequency components which fall above the voicing cut-off frequency are normalized to their corresponding band energies. Specifically, with reference to the single-excitation energy parameter example considered above, the normalization β is computed from the transmitted excitation energy A, the total number of harmonics L, as determined by the pitch, and the number of voiced harmonics Lv, determined from the voicing probability Pv, as follows:

$$\beta = \sqrt{\frac{A^2(L - Lv)}{E_n}}$$

where En is the energy of the noise sequence at the output of block 630.

The normalized noise sequence is next inverse Fourier transformed in block 650 to obtain a time-domain signal. In order to eliminate discontinuities at the frame edges, the synthesis window size is generally selected to be longer than the speech update size. As a result, the unvoiced excitation for each frame overlaps that of neighboring frames which eliminates the discontinuity at the frame boundaries. A weighted overlap-add procedure is therefore used in block 660 to process the unvoiced part of the excitation signal.

In a preferred embodiment of the present invention, blocks 630, 620 and 630 can be combined in a single memory block (not shown) which stores a set of pre-filtered noise sequences. In particular, stored as codebook entries are several pre-computed noise sequences which represent a time-domain signal that corresponds to different "unvoiced" portions of the spectrum of a speech signal. In a specific embodiment of the present invention, 16 different entries can be used to represent a whole range of unvoiced excitation signals which correspond to such 16 different voicing probabilities. For simplicity it is assumed that the spectrum of the original signal is divided into 16 equal-width portions which correspond to those 16 voicing probabilities. Other divisions, such as a logarithmic frequency division in one or more parts of the signal spectrum, can also be used and are determined on the basis of computational complexity considerations or some subjective performance measure for the system.

Figure 8:
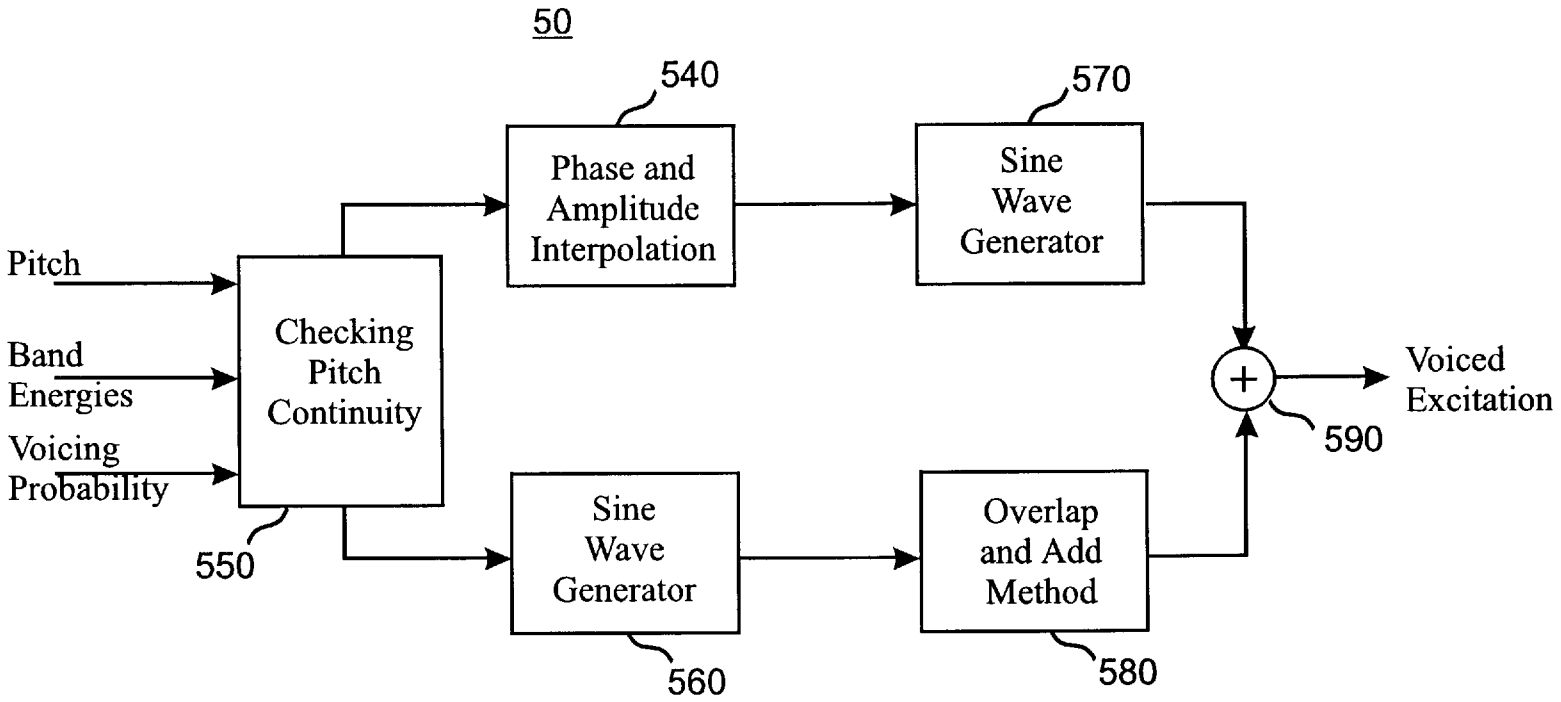
FIG. 8 illustrates a method of generating the voiced portion of the excitation signal in accordance with the present invention.

FIG. 8 is a block diagram of the voiced excitation synthesis algorithm in accordance with a preferred embodiment of the present invention. As shown, block 550 receives on input the pitch, the voicing probability Pv, and the excitation band energies. The voiced excitation is represented using a set of sinusoids harmonically related to the pitch. In a specific embodiment of the present invention in which only the total energy of the excitation signal has been transmitted, the amplitudes of all harmonic frequencies are assumed to be equal. Conditions for amplitude and phase continuity at the boundaries between adjacent frames can be computed, as shown for example in copending U.S. patent application Ser. No. 08/273,069 to one of the co-inventors of the present application. The content of this application is hereby expressly incorporated for all purposes.

In an alternative embodiment of the present invention directed to the general case when more than one excitation band energies are transmitted, the voiced excitation is represented as a sum of harmonic sinusoids of the pitch as:

$$e_v(t) = \sigma(t) \sum_{k=0}^{L} \cos[\psi_k(t)]$$

where $\sigma(t)$ is the interpolated average harmonic excitation energy function and $\psi_k(t)$ is the phase function of the excitation harmonics. The harmonic amplitudes are obtained by linearly interpolating the band energies and sampling the interpolated energies at the harmonics of the pitch frequency. Furthermore, the excitation energy function is linearly interpolated between frames, with the harmonics corresponding to the unvoiced portion of the spectrum being set to zero. The phase function of the speech signal is determined by the initial phase $\phi_0$ which is completely predicted using previous frame information and linear frequency track $w_k(t)$. To determine the phase of the excitation signal, the phases of the speech signal and the LPC inverse filter are added together to form the excitation phase as:

$$\psi_k(t)=\theta_k(t)+\delta_k(t)$$

where $\delta_k(t)$ is the phase of LPC inverse filter corresponding to the k-th frequency track at time t. As the phase function $\theta_k(t)$ is dependent on the initial phase $\phi_0$ and the frequency deviation $\Delta w_\epsilon$, the parameters $\phi_0$ and $\Delta w_\epsilon$ are chosen so that the principal values of $\theta_k(0)$ and $\theta_k(-N)$ are equal to the predicted harmonic phases in the current and the previous frame, respectively.

When k harmonics of the current and previous frames fall within the voiced portion of the spectrum, the initial phase $\phi_0$ set to the predicted phase of the current frame and $\Delta\phi_k$ is chosen to be the smallest frequency deviation required to match the phase of the previous frame. When either of the corresponding harmonics in two adjacent frames is declared unvoiced, only the initial phase parameter is required to match the phase function $\theta_\kappa(t)$ with the phase of the voiced harmonic ($\Delta\omega_k$ is set to zero). When corresponding harmonics in adjacent frames both fall within the unvoiced portion of the spectrum, the function $\sigma(t)$ is set to zero over the entire interval between frames, so that a random phase function can be used. Large differences in fundamental frequency can occur between adjacent frames due to word boundaries and other effects. In these cases, linear interpolation of the fundamental frequency between frames is a poor model of the pitch variation, and can lead to artifacts in the synthesized signal. Consequently, when pitch frequency changes of more than about 10% are encountered between adjacent frames, the harmonics in the voiced portion of the spectrum for the current frame and the corresponding harmonics in the previous frame are treated as if followed and preceded, respectively, by unvoiced harmonics.

C. Speech Enhancement

Several techniques, including LPC interpolation and frequency domain post-filtering have been developed to improve subjectively the output speech quality of speech coder in accordance with a preferred embodiment of the present invention.

C.1 LPC Interpolation

In addition to the order p of the LPC analysis used, as known in the art, the frame by frame update of the LPC analysis coefficient determines the degree of accuracy with which the LPC filter can model the spectrum of the speech signal. Thus for example, during sustained regions of slowly changing spectral characteristics, the frame by frame update can cope reasonably well. However, in transition regions which are believed to be perceptually more important, it will fail as transitions fall within a single frame and thus cannot be represented accurately. During such transition intervals, the calculated set of parameters will only represent an average of the changing shape of the spectral characteristics of that speech frame. To model the transitions more accurately, in accordance with a preferred embodiment of the present invention, the update rate of the analysis is to be increased so that the frame length is much larger than the number of new samples used per frame, i.e. the window is spread across past, current and future samples.

As those skilled in the art will appreciate, the disadvantages of this technique are that greater algorithmic delay is introduced; if the shift of the window (i.e. number of new samples used per update) is small, the coding capacity is increased; and if the shift of the window is long, although the coding capacity is decreased, the accuracy of the excitation modelling also decreases. Therefore, a trade-off is required between accurate spectral modelling, excitation modelling, delay and coding efficiency. In accordance with a preferred embodiment, one approach to satisfying this tradeoff is the use of frame-to-frame LPC interpolation. Generally, the idea is to achieve an improved spectrum representation by evaluating intermediate sets of parameters between frames, so that transitions are introduced more smoothly at the frame edges without the need to increase the coding capacity. The interpolation type can either be linear or nonlinear.

As the LPC coefficients in accordance with the present invention are quantized in the form of LSFs, it is preferable to linearly interpolate the LSF coefficients across the frame using the previous and current frame LSF coefficients. Specifically, if the time between two speech frames corresponds to N samples, the LSF interpolation function is given by $$LSF_k(n) = lsf_{m-1}(k) + [lsf_m(k) - lsf_{m-1}(k)]\frac{n}{N}$$

where $lsf_m(\kappa)$ corresponds to the κth LSF coefficient in the $_m$ frame and $0 \leqq n < N$. The interpolated LSFs are then converted to LPC coefficients, which will be used in the LPC synthesis filter. This interpolation procedure automatically tracks the formants and valleys from one formant to another, which makes the output speech smoother. It was found that the improvement due to the LPC interpolation is in all cases very noticeable. The smoothness of the processed speech was considerably enhanced, while speech from faster speakers was noticeably improved. However, sample-by-sample LPC interpolation is computationally very expensive. Therefore, the speech frame is broken into five or six subframes requiring five or six interpolation points in the center of each. This reduces the computational complexity of the algorithm considerably, while producing almost identical speech quality.

C.2 Frequency Domain Post-Filtering

Figure 10:
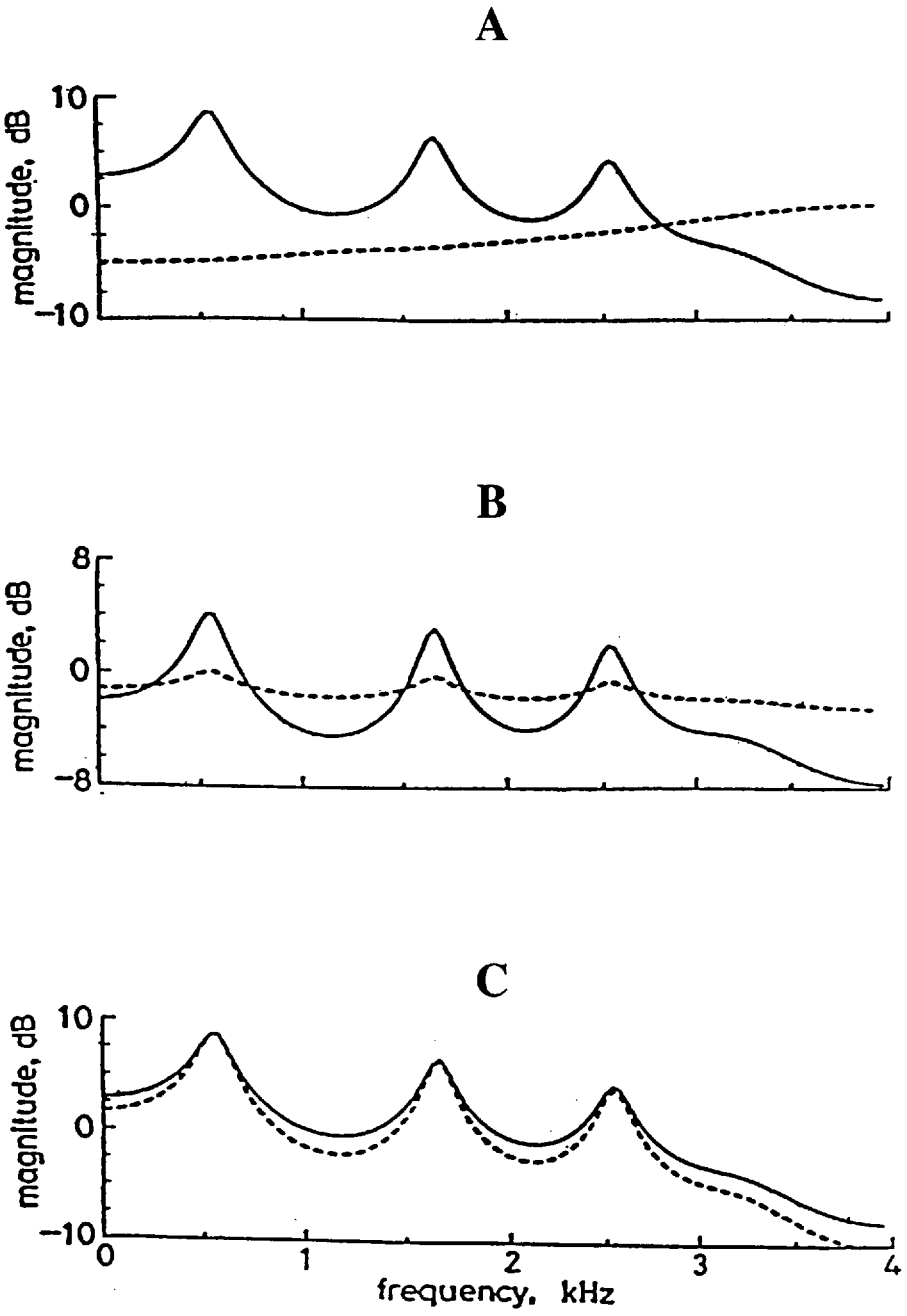
FIG. 10 illustrates the frequency domain characteristics of the post-filtering operation used in accordance with the present invention.

Referring back to FIG. 3, in accordance with a preferred embodiment of the present invention a post-filter 80 is used to shape the noise and improve the perceptual quality of the synthesized speech. Generally, in noise shaping, lowering noise components at certain frequencies can only be achieved at a price of increased noise components at other frequencies. As speech formants are much more important to perception than the formant nulls, the idea is to preserve the formant information by keeping the noise in the formant regions as low as possible. The first step in the design of the frequency domain postfilter is to weight the measured spectral envelope $$R_\omega(\omega)=H(\omega)W(\omega)$$

in order to remove the spectral tilt and produce an even, i.e., more flat spectrum. In the expression above, $H(\omega)$ is the measured spectral envelope (See FIG. 10A) and W(ω) is the weighting function, represented as $$W(\omega) = \frac{1}{H(\omega,\gamma)} = 1 + \sum_{k=1}^{p} a_k \gamma^k e^{-j\omega k}$$

where the coefficient γ is between 0 and 1, and the frequency response H(ω) of the LPC filter can be computed as:

$$H(\omega) = \frac{1}{1 + \sum_{k=1}^{p} a_k e^{-j\omega k}}$$

where $a_\kappa$ is the coefficient of a ρth order all-pole LPC filter and γ is the weighting coefficient, which is typically 0.5. See FIG. 7. The weighted spectral envelope, $R_\omega(\omega)$ is then normalized to have unity gain, and taken to the power of β, which is preferably set equal to 0.2. If $R_{max}$ is the maximum value of the weighted spectral envelope, the postfilter is taken to be $$P_f(\omega) = \left( \frac{R_\omega(\omega)}{R_{max}} \right)^{\beta}; 0 \leqq \beta \leqq 1.$$

The idea is that, at the formant peaks, the normalized weighted spectral envelope will have unity gain and will not be altered by the effect of β. This will be true even if the low-frequency formants are significantly higher than those at the high-frequency end. The value of the parameter β controls the distance between formant peaks and nulls, so that, overall, a Wiener-type filter characteristic will result (See FIG. 10B). The estimated postfilter frequency response is then used to weight the original speech envelope to give $$H(\overline{\omega}) = P_f(\overline{\omega}) H(\overline{\omega})$$

Figure 7:
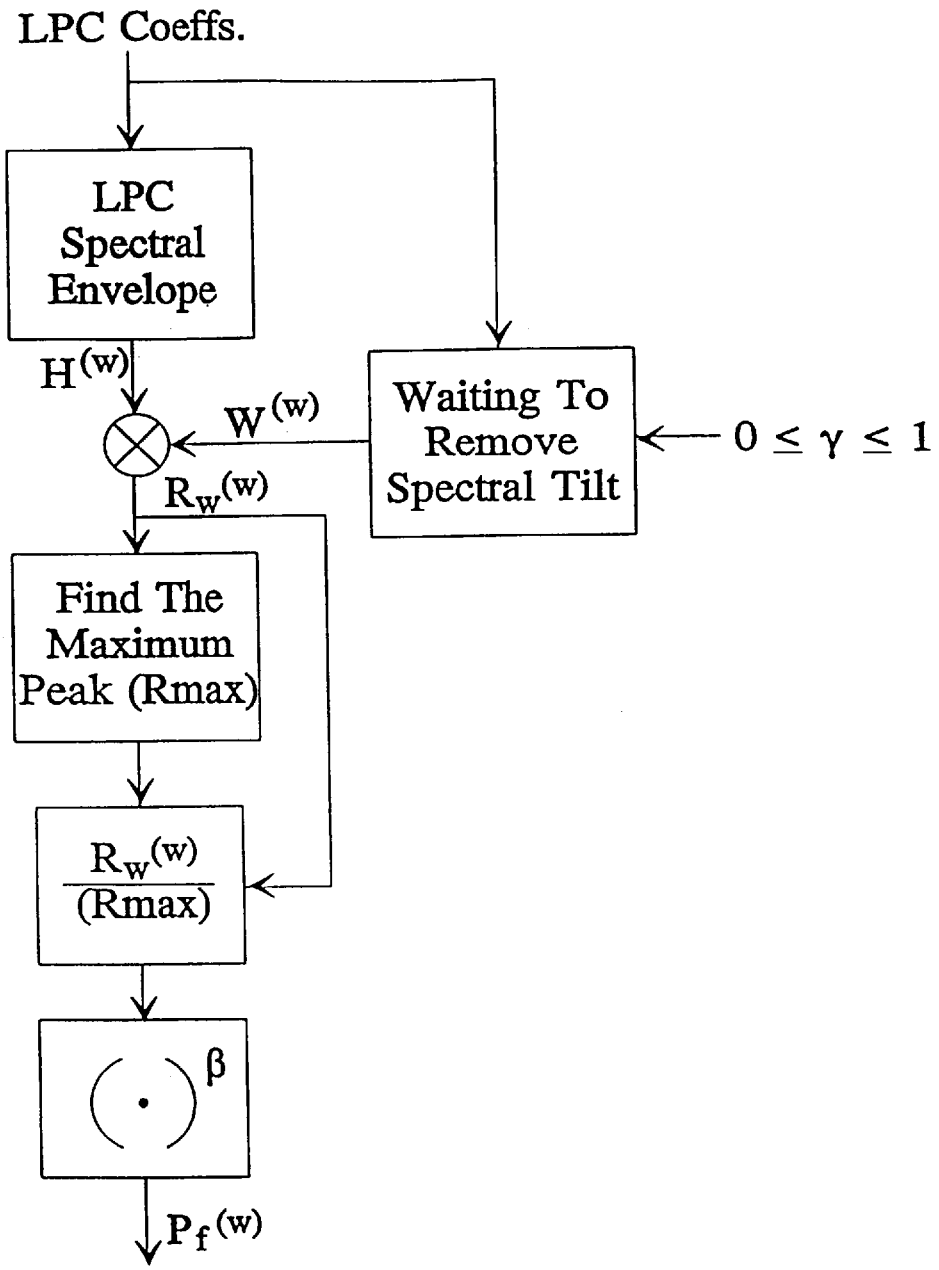
FIG. 7 shows in a flow-chart form the operation of the frequency domain post-filter in accordance with the present invention.

This causes the formants to narrow nd reduces the depth of the formant nulls, thereby reducing the effects of the noise without introducing a spectral tilt in the spectrum, which is very common in pole-zero postfilters. (See FIG. 10C) When applied to the decoder part of the system in accordance with the present invention, it has been observed that the resulting system produces much improved speech quality. The postfiltering steps used in accordance with a specific embodiment of the present invention are illustrated in FIG. 7.

C.3 Synthesizing the Final Speech Output

With reference to FIG. 3, after synthesizing the LPC excitation signal on the output of block 55, and applying the enhancement techniques discussed above on the synthesized LPC excitation, a LPC synthesis filtering is performed using the interpolated LPC parameters by passing the excitation through the LPC filter 90 to obtain the final synthesized speech signal.

Decoder block 8 has been described with reference to a specific preferred embodiment of the system of the present invention. As discussed in more detail in Section A above, however, the system of this invention is modular in the sense that different blocks can be used for encoding of the voiced and unvoiced portions of the signal dependent on the application and other user-specified criteria. Accordingly, for each specific embodiment of the encoder of the system, corresponding changes need to be made in the decoder 8 of the system for synthesizing output speech having desired quantitative and perceptual characteristics. Such modifications should be apparent to a person skilled in the art and will not be discussed in further detail.

D. Applications

The method and system of the present invention described above in a preferred embodiment using 2.4 kb/s can in fact provide the capability of accurately encoding and synthesizing speech signals for a range of user-specific applications. Because of the modular structure of the system in which different portions of the signal spectrum can be processed separately using different suitably optimized algorithms, the encoder and decoder blocks can be modified to accommodate specific user needs, such as different system bit rates, by using different signal processing modules. Furthermore, in addition to straight speech coding, the analysis and synthesis blocks of the system of the present invention can also be used in speech enhancement, recognition and in the generation of voice effects. Furthermore, the analysis and synthesis method of the present invention, which are based on voicing probability determination, provide natural sounding speech which can be used in artificial synthesis of a user's voice.

The method and system of the present invention may also be used to generate a variety of sound effects. Two different types of voice effects are considered next in more detail for illustrative purposes. The first voice effect is what is known in the art as time stretching. This type of sound effect may be created if the decoder block uses synthesis frame sizes different from that of the encoder. In such case, the synthesized time segments are expanded or contracted in time compared to the originals, changing the rate of playback. In the system of the present invention this effect can easily be accomplished simply by using, in the decoder block 8, of different values for the frame length N and the overlap portion between adjacent frames. Experimentally it has been demonstrated that the output signal of the present system can be effectively changed with virtually no perceptual degradation by a factor-of about five in each direction (expansion or contraction). Thus, the system of the present invention is capable of providing a naturally sounding speech signal over a range of applications including dictation, voice scanning, and others. (Notably, the perceptual quality of the signal is preserved because the fundamental frequency $F_0$ and the general position of the speech formants in the spectrum of the signal is preserved).

In addition, changing the pitch frequency $F_0$ and the harmonic amplitudes in the decoder block will have the perceptual effect of altering the voice personality in the synthesized speech with no other modifications of the system being required. Thus, in some applications while retaining comparable levels of intelligibility of the synthesized speech the decoder block of the present invention may be used to generate different voice personalities. Specifically, in a preferred embodiment, the system of the present invention is capable of generating a signal in which the pitch corresponds to a predetermined target value $F_{0T}$. A simple mechanism by which this voice effect can be accomplished can be described briefly as follows. Suppose for example that the spectrum envelope S(ω) of an actual speech signal and the fundamental frequency $F_0$ and its harmonics have given values. Using the system of the present invention the model spectrum S(ω) can be generated from the reconstructed output signal. (Notably, the pitch period and its harmonic frequencies are directly available as encoding parameters). Next, the continuous spectrum S(ω) can be re-sampled to generate the spectrum amplitudes at the target fundamental frequency $F_{0T}$ and its harmonics. In an approximation, such re-sampling, in accordance with a preferred embodiment of the present invention, can easily be computed using linear interpolation between the amplitudes of adjacent harmonics.

Next, at the synthesis block, instead of using the originally received pitch $F_0$ and the amplitudes of its harmonics, one can use the target values obtained by interpolation, as indicated above. This pitch shifting operation has been shown in real time experiments to provide perceptually very good results. Furthermore, the system of the present invention can also be used to dynamically change the pitch of the reconstructed signal in accordance with a sequence of target pitch values, each target value corresponding to a specified number of speech frames. The sequence of target values for the pitch can be pre-programmed for generation of a specific voice effect, or can be interactively changed in real time by the user.

It should further be noted that while the method and system of the present invention have been described in the context of a specific speech processing environment, they are also applicable in the more general context of audio processing. Thus, the input signal of the system may include music, industrial sounds and others. In such case, dependent on the application, it may be necessary to use sampling frequency higher or lower than the one used for speech, and also adjust the parameters of the filters in order to adequately represent all relevant aspects of the input signal. Furthermore, harmonic amplitudes corresponding to different tones of a musical instrument can also be stored at the decoder of the system and used independently for music synthesis. Compared to conventional methods, music synthesis in accordance with the method of the present invention has the benefit of using significantly less memory space as well as more accurately representing the perceptual spectral content of the audio signal.

In accordance with the present invention the low bit rate system of the present invention can be used in a variety of other applications, including computer and multimedia games, transmission of documents with voice signatures attached, Internet browsing, and others, where it is important to keep the bit rate of the system relatively low, while the quality of the output speech patters need not be very high. Other applications of the system and method of the present invention will be apparent to those skilled in the art.

While the invention has been described with reference to a preferred embodiment, it will be appreciated by those of ordinary skill in the art that modifications can be made to the structure and form of the invention without departing from its spirit and scope which-is defined in the following claims. An alternative description of the system and method of the present invention which can assist the reader in understanding specific aspects the invention is attached.

What is claimed is:

1. A method for processing an audio signal comprising:

dividing the signal into segments, each segment representing one of a succession of time intervals;

computing for each segment a model of the signal in such segment;

subtracting the computed model from the original signal to obtain a residual excitation signal;

detecting for each segment the presence of a fundamental frequency $F_0$;

determining for the excitation signal in each segment a ratio between voiced and unvoiced components of the signal in such segment on the basis of the fundamental frequency $F_0$, said ratio being defined as a voicing probability Pv;

separating the excitation signal in each segment into a voiced portion and an unvoiced portion on the basis of the voicing probability Pv; and encoding parameters of the model of the signal in each segments and the voiced portion and the unvoiced portion of the excitation signal in each segment in separate data paths.

2. The method of claim 1 wherein the audio signal is a speech signal and detecting the presence of a fundamental frequency $F_0$ comprises computing the spectrum of the signal in a segment.

3. The method of claim 2 wherein the voiced portion of the signal occupies the low end of the spectrum and the unvoiced portion of the signal occupies the high end of the spectrum for each segment.

4. The method of claim 1 wherein computing a model comprises modeling the spectrum of the signal in each segment as the output of a linear time-varying filter.

5. The method of claim 4 wherein modeling the spectrum of the signal in each segment comprises computing a set of linear predictive coding (LPC) coefficients and encoding parameters of the model of the signal comprises encoding the computed LPC coefficients.

6. The method of claim 5 wherein encoding the LPC coefficients comprises computing line spectral frequencies (LSF) coefficients corresponding to the LPC coefficients and encoding of the computed LSF coefficients for subsequent storage and transmission.

7. The method of claim 1 further comprising: forming one or more data packets corresponding to each segment for subsequent transmission or storage, the one or more data packets comprising: the fundamental frequency $F_0$, data representative of the computed model of the signal, and the voicing probability Pv for the signal.

8. The method of claim 7 further comprising: receiving the one or more data packets; and synthesizing audio signals from the received one or more data packets data packets.

9. The method of claim 8 wherein synthesizing audio signal comprises:

decoding the received one or more data packets to extract: the fundamental frequency, the data representative of the computed model of the signal and the voicing probability Pv for the signal.

10. The method of claim 9 further comprising:

synthesizing an audio signal from the extracted data, wherein the low frequency band of the spectrum of said synthesized audio signal is synthesized using data representative of the voiced portion of the signal; the high frequency band of the spectrum of said synthesized audio signal is synthesized using data representative of the unvoiced portion of the signal and the boundary between the low frequency band and the high frequency band of the spectrum is determined on the basis of the decoded voicing probability Pv.

11. The method of claim 10 wherein the audio signal being synthesized is a speech signals and synthesizing further comprises:

providing amplitude and phase continuity on the boundary between adjacent synthesized speech segments.

12. A system for processing an audio signal comprising:

means for dividing the signal into segments, each segment representing one of a succession of time intervals;

means for computing for each segment a model of the signal in such segment;

means for subtracting the computed model from the original signal to obtain a residual excitation signal;

means for detecting for each segment the presence of a fundamental frequency $F_0$;

means for determining for the excitation signal in each segment a ratio between voiced and unvoiced components of the signal in such segment on the basis of the fundamental frequency $F_0$, said ratio being defined as a voicing probability Pv;

means for separating the excitation signal in each segment into a voiced portion and an unvoiced portion on the basis of the voicing probability Pv; and means for encoding parameters of the model of the signal in each segments and the voiced portion and the unvoiced portion of the excitation signal in each segment in separate data paths.

13. The system of claim 12 wherein the audio signal is a speech signal and the means for detecting the presence of a fundamental frequency $F_0$ comprises means for computing the spectrum of the signal.

14. The system of claim 13 further comprising: means for computing LPC coefficients for a signal segment; and means for transforming LPC coefficients into line spectral frequencies (LSF) coefficients corresponding to the LPC coefficients.

15. The system of claim 12 wherein said means for determining a ratio between voiced and unvoiced components further comprises:

means for generating a fully voiced synthetic spectrum of a signal corresponding to the detected fundamental frequency $F_0$;

means for evaluating an error measure for each frequency bin corresponding to harmonics of the fundamental frequency in the spectrum of the signal; and means for determining the voicing probability Pv of the segment as the ratio of harmonics for which the evaluated error measure is below certain threshold and the total number of harmonics in the spectrum of the signal.

16. The system of claim 12 further comprising:

means for forming one or more data packets corresponding to each segment for subsequent transmission or storage, the one or more data packets comprising: the fundamental frequency $F_0$, data representative of the computed model of the signal, and the voicing probability Pv for the signal.

17. The system of claim 16 further comprising:

means for receiving the one or more data packets over communications medium; and means for synthesizing audio signals from the received one or more data packets data packets.

18. The system of claim 17 wherein said means for synthesizing audio signals comprises:

means for decoding the received one or more data packets to extract: the fundamental frequency, the data representative of the computed model of the signal and the voicing probability Pv for the signal.

19. The system of claim 18 further comprising:

means for synthesizing an audio signal from the extracted data, wherein the low frequency band of the spectrum of said synthesized audio signal is synthesized using data representative of the voiced portion of the signal; the high frequency band of the spectrum of said synthesized audio signal is synthesized using data representative of the unvoiced portion of the signal and the boundary between the low frequency band and the high frequency band of the spectrum is determined on the basis of the decoded voicing probability Pv.

20. The system of claim 19 wherein the audio signal being synthesized is a speech signals and synthesizing further comprises:

means for providing amplitude and phase continuity on the boundary between adjacent synthesized speech segments.

21. A method for synthesizing audio signals from one or more data packets representing at least one time segment of a signal, the method comprising:

decoding said one or more data packets to extract data comprising: a fundamental frequency parameter, parameters representative of a spectrum model of the signal in said at least one time segment, and a voicing probability Pv defined as a ratio between voiced and unvoiced components of the signal in said at least one time segment;

generating a set of harmonics H corresponding to said fundamental frequency, the amplitudes of said harmonics being determined on the basis of the model of the signal, and the number of harmonics being determined on the basis of the decoded voicing probability Pv; and synthesizing an audio signal using the generated set of harmonics.

22. The method of claim 21 wherein the model of the signal is an LPC model, the extracted data further comprises a gain parameter, and the amplitudes of said harmonics are determined using the gain parameter by sampling the LPC spectrum model at harmonics of the fundamental frequency.

23. The method of claim 22 wherein the audio signal is speech and generating a set of harmonics comprises applying a frequency domain filtering to shape the LPC spectrum as to improve the perceptual quality of the synthesized speech.

24. The method of claim 23 wherein the frequency domain filtering is applied in accordance with the expression $$P_f(\omega) = \left( \frac{R_\omega(\omega)}{R_{max}} \right)^\beta ; 0 \leqq \beta \leqq 1.$$

where $$R_\omega(\omega) = H(\omega)W(\omega)$$

where $$R_\omega(\omega)=H(\omega)W(\omega)$$

in which W(ω) is the weighting function, represented as $$W(\omega) = \frac{1}{H(\omega,\gamma)} = 1 + \sum_{k=1}^{p} a_k \gamma^k e^{-j\omega k}$$

the coefficient γ is between 0 and 1, and the frequency response H(ω) of the LPC filter is given by:

$$H(\omega) = \frac{1}{1 + \sum_{k=1}^{p} a_k e^{-j\omega k}}$$

where $a_{78}$ is the coefficient of a ρth order all-pole LPC filter, γ is the weighting coefficient, and $R_{max}$ is the maximum value of the weighted spectral envelope.

25. The method of claim 22 wherein said parameters representative of a spectrum model are LSF coefficients corresponding to the LPC spectrum model.

26. The method of claim 25 wherein synthesizing an audio signal comprises linearly interpolating LSF coefficients across a current segment using LSF coefficients from the previous segment as to increase the accuracy of the signal synthesis.

27. The method of claim 26 wherein linear interpolating LSF is applied at two or more subsegments of the signal.

28. A method for synthesizing audio signals from one or more data packets representing at least one time segment of a signal, the method comprising:

decoding said one or more data packets to extract data comprising: a fundamental frequency parameter, parameters representative of a spectrum model of the signal in said at least one time segment, one or more parameters representative of a residual excitation signal associated with said spectrum model of the signal, and a voicing probability Pv defined as a ratio between voiced and unvoiced components of the signal in said at least one time segment;

providing a filter, the frequency response of which corresponds to said spectrum model of the signal; and synthesizing an audio signal by passing a residual excitation signal through the provided filter, said residual excitation signal being generated from said fundamental frequency, said one or more parameters representative of a residual excitation signal associated with said spectrum model of the signal, and the voicing probability Pv.

29. The method of claim 28 wherein the provided filter is a LPC filter, and said one or more parameters representative of a residual excitation signal comprises a gain parameter.

30. The method of claim 28 wherein the audio signal is speech and synthesizing an audio signal comprises applying frequency domain filtering to shape the residual excitation signal as to improve the perceptual quality of the synthesized speech.

31. The method of claim 28 wherein said parameters representative of a spectrum model are LSF coefficients corresponding to a LPC spectrum model.

32. The method of claim 31 wherein synthesizing an audio signal comprises linearly interpolating LSF coefficients across a current segment using LSF coefficients from the previous segment as to increase the accuracy of the signal synthesis.

* * * * *